US006793364B2

(12) United States Patent
Cramer et al.

(10) Patent No.: US 6,793,364 B2
(45) Date of Patent: Sep. 21, 2004

(54) NON-LETHAL VISUAL BIRD DISPERSAL SYSTEM

(75) Inventors: Eric J. Cramer, Albuquerque, NM (US); Michael D. Tocci, Sandia Park, NM (US)

(73) Assignee: Science & Engineering Associates, Inc., Albuquerque, NM (US)

( * ) Notice: Subject to any disclaimer, the term of this patent is extended or adjusted under 35 U.S.C. 154(b) by 0 days.

(21) Appl. No.: 10/175,930

(22) Filed: Jun. 20, 2002

(65) Prior Publication Data

US 2002/0154498 A1 Oct. 24, 2002

Related U.S. Application Data

(63) Continuation-in-part of application No. 09/785,701, filed on Feb. 16, 2001, now Pat. No. 6,575,597, which is a continuation-in-part of application No. 09/409,328, filed on Sep. 30, 1999, now Pat. No. 6,190,022, which is a continuation-in-part of application No. 08/967,426, filed on Nov. 10, 1997, now Pat. No. 6,007,218, which is a continuation-in-part of application No. 08/518,230, filed on Aug. 23, 1995, now Pat. No. 5,685,636.

(60) Provisional application No. 60/300,347, filed on Jun. 22, 2001, and provisional application No. 60/135,231, filed on May 21, 1999.

(51) Int. Cl.[7] ..... F41G 1/34; F21V 19/02

(52) U.S. Cl. ..... 362/112; 362/188; 362/259; 362/285

(58) Field of Search ..... 362/110–114, 187, 362/188, 253, 259, 285

(56) References Cited

U.S. PATENT DOCUMENTS

| | | | | |
|---|---|---|---|---|
| 2,353,082 A | | 7/1944 | Roedding et al. | 240/48 |
| 3,013,145 A | | 12/1961 | Trippe | 240/49 |
| 3,062,144 A | | 11/1962 | Hori et al. | 102/38 |
| 4,048,631 A | | 9/1977 | Flores | 362/184 |
| 4,281,993 A | * | 8/1981 | Shaw | 362/113 |
| 4,736,907 A | | 4/1988 | Steffen | 244/1 R |
| 4,934,086 A | * | 6/1990 | Houde-Walter | 362/110 |

(List continued on next page.)

FOREIGN PATENT DOCUMENTS

| | | | |
|---|---|---|---|
| FR | 2662234 | 11/1991 | F21M/1/00 |
| JP | 406284847 | 10/1994 | A01M/29/00 |
| JP | 0970250 | 3/1997 | A01M/29/02 |
| WO | WO 97/08489 | 3/1997 | |
| WO | WO 99/24755 | 5/1999 | |

OTHER PUBLICATIONS

U.S. patent application Ser. No. 09/785,701, Cramer et al., filed Feb. 16, 2001.

U.S. Provisional patent application Ser. No. 60/300,347, Cramer et al., filed Jun. 22. 2001.

Desman S.A.R.L. Web site, www.desman.fr, downloaded Nov. 22, 2002, product information including photographs.

*Primary Examiner*—Alan Cariaso

(74) *Attorney, Agent, or Firm*—Perkins Smith & Cohen, LLP; Jacob N. Erlich

(57) ABSTRACT

A non-lethal method and devices for dispersing nuisance birds from a preselected area. Such nuisance birds disrupt many activities such as the steady flow of safely moving aircraft on runways and adjacent thereto, growing crops on farmland, playing golf and the use of the interior of large open buildings. The present method utilizes a series of bright light sources that are positioned adjacent the area from which the birds are to be dispersed. The light sources are activated to produce one or more beams of bright light that are moved in such a manner to produce a pattern of bright light in the vicinity of the birds to be dispersed. This action causes the birds to become sufficiently startled and disoriented so as to disperse these nuisance birds from the area to be cleared.

20 Claims, 23 Drawing Sheets

U.S. PATENT DOCUMENTS

| | | | | | |
|---|---|---|---|---|---|
| 4,963,798 | A | | 10/1990 | McDermott | 362/231 |
| 5,072,342 | A | | 12/1991 | Minovitch | 362/111 |
| 5,243,894 | A | | 9/1993 | Minovitch | 89/1.11 |
| 5,319,367 | A | | 6/1994 | Schulte et al. | 340/961 |
| 5,355,609 | A | * | 10/1994 | Schenke | 362/110 |
| 5,375,043 | A | | 12/1994 | Tokunaga | 362/231 |
| 5,417,573 | A | | 5/1995 | Cassiere, II et al. | 434/21 |
| 5,425,299 | A | * | 6/1995 | Teetzel | 89/14.4 |
| 5,450,063 | A | | 9/1995 | Peterson et al. | 340/573 |
| 5,481,819 | A | * | 1/1996 | Teetzel | 42/117 |
| 5,527,308 | A | | 6/1996 | Anderson et al. | 606/14 |
| 5,584,137 | A | | 12/1996 | Teetzel | 42/103 |
| 5,618,099 | A | * | 4/1997 | Brubacher | 362/111 |
| 5,685,636 | A | | 11/1997 | German | 362/259 |
| 5,713,654 | A | | 2/1998 | Scifres | 362/259 |
| 5,734,504 | A | | 3/1998 | Billman | 359/618 |
| 5,761,235 | A | | 6/1998 | Houde-Walter | 372/77 |
| 5,808,226 | A | | 9/1998 | Allen et al. | 89/1.11 |
| 5,814,041 | A | | 9/1998 | Anderson et al. | 606/15 |
| 6,007,218 | A | | 12/1999 | German et al. | 362/259 |
| 6,007,219 | A | | 12/1999 | O'Meara | 362/259 |
| 6,190,022 | B1 | | 2/2001 | Tocci et al. | 362/259 |
| 6,367,943 | B1 | | 4/2002 | Tocci et al. | 362/103 |
| 6,407,607 | B1 | | 6/2002 | Hsu | 327/284 |

* cited by examiner

GOLF COURSE, FARM LAND, AIRFIELD, ETC.

HANGER, WAREHOUSE, ETC.

NON-LETHAL VISUAL BIRD DISPERSAL SYSTEM

CROSS REFERENCE TO RELATED APPLICATIONS

This application claims priority of Provisional Application No. 60/300,347, entitled NON-LETHAL VISUAL BIRD DISPERSAL SYSTEM filed on Jun. 22, 2001, and is a continuation-in-part of and claims priority of U.S. patent application Ser. No. 09/785,701 filed Feb. 16, 2001 now U.S. Pat. No. 6,575,597 entitled NON-LETHAL VISUAL BIRD DISPERSAL SYSTEM which in turn is a continuation-in-part of and claims priority of copending U.S. patent application Ser. No. 09/409,328 filed Sep. 30, 1999 entitled ENHANCED NON-LETHAL VISUAL SECURITY DEVICE now U.S. Pat. No. 6,190,022 which claims priority of Provisional Application No. 60/135,231 filed May 21, 1999 and which in turn is a continuation-in-part of U.S. patent application Ser. No. 08/967,426 filed Nov. 10, 1997 entitled SELF-CONTAINED LASER ILLUMINATOR MODULE now U.S. Pat. No. 6,007,218 which is a continuation-in-part of U.S. patent application Ser. No. 08/518,230 filed Aug. 23, 1995 entitled EYE SAFE LASER SECURITY DEVICE now U.S. Pat. No. 5,685,636. A PCT application S.N. PCT/US98/01662 was filed on Jan. 29, 1998 based upon U.S. patent application Ser. No. 08/967,426. Another PCT Application Serial No. PCT/US96/13556 is based upon U.S. patent application Ser. No. 08/518,230. All applications and patents are incorporated herein by reference.

BACKGROUND OF THE INVENTION

This invention relates generally to a bird dispersal methodology and device and, more particularly, to non-lethal, bird dispersal methods and devices based on intense light to provide a means of dispersing nuisance birds.

Birds in general pose serious problems in several areas of society. These problems range from the physical presence of birds, such as birds roosting on or near airport runways, increasing the probability of bird/aircraft strikes, to property damage resulting from bird excrement on equipment or structures.

In recent years, due to changes in land use, climate changes, and cultural practices, populations of several avian species has increased. Associated with this increase in population, is damage to property as well as increased risks to human health and safety. Although these problems are on the rise, the number of management options available to control birds has been limited to non-lethal approaches.

There are three primary areas of concern with nuisance birds: 1) potential of injury or death and associated property damage from bird strikes on aircrafts; 2) damage to property from bird excrement and nesting materials inside warehouses, public parks, golf courses, aircraft hangers, buildings, and rooftops; and 3) the depredation of crops in the agriculture and aquaculture industries. The impact nuisance birds have on these areas is primarily economic. Any means to limit the number of birds in these areas and the associated damages is of great value. Past bird dispersal techniques generally employed the use of high volume audible alarms or explosives to disperse birds. These devices, however, were limited to rural areas where the intense noise did not disturb residents.

It is therefore an object of this invention to provide a method to control and disperse nuisance birds through the use of intense light.

It is another object of this invention to provide a non-lethal, visual bird dispersal device that is capable of low cost manufacture.

It is still another object of this invention to provide a non-lethal, visual bird dispersal device that is extremely effective as an avian repellent under a wide range of conditions.

It is a further object of this invention to provide a non-lethal, visual bird dispersal device that is capable of automated, unmanned operation in a wide range of conditions.

SUMMARY OF THE INVENTION

The objects set forth above as well as further and other objects and advantages of the present invention are achieved by the embodiments of the invention described herein below.

The present invention provides a system and method of using intense light for the purpose of dispersing nuisance birds. The method incorporates therein, but not limited to, the inclusion therein of a device or plurality of devices capable of producing cost effective laser light directly from a laser diode source or light from light emitting diodes (LED's), as well the incorporation of an automated scanning system to facilitate unmanned operation of the device(s).

More specifically, the present invention provides an effective system for projecting light directly from a laser diode source to provide a beam of relative intensity. By the addition of an automated scanning system within the present invention, and the method in which it is used, the system can be operated in an autonomous manner allowing for unmanned use.

The use of intense light to disperse birds is suitable for use in virtually all rural or urban settings. Different configurations of the projected light can be used to increase effectiveness depending on the intended area of use. For those scenarios where the target area is in an urban setting, or where precise control of the light is required to limit human exposure, the light can be configured as a spot allowing for precise placement of the light on a specific target or individual bird. For those scenarios where the target area is much larger, as in agriculture or aquaculture industry, the light can be configured as a line of appropriate divergence allowing for a single sweep of the device to cover the entire area of interest.

The present method of this invention for nuisance bird dispersal utilizes laser security devices such as described in U.S. Pat. No. 5,685,636, U.S. Pat. No. 6,007,218 and U.S. patent application Ser. No. 09/409,328, all incorporated herein by reference which employ the same light sources at any narrow wavelength band between 400 and 700 nanometers (the entire visible light spectrum from blue to red) and provide either continuous or repetitively pulsed (on-off flashing) light. The present invention addresses the use of laser devices in a method suitable for use as a bird dispersal device, either hand held or mounted to an unmanned automated scanning device.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

In order to better understand the present invention, the following description provides a basic overview of the methodology of this invention followed by a detailed description of the various preferred embodiments of this invention for effecting those concepts in enhanced non-lethal bird dispersal devices.

More specifically, ultra bright light sources offer an effective non-lethal approach to control and disperse birds. The predominant effect generated from the light is psychological. The laser light projects a visible spot, moving or stationary, on or near the target bird(s). This simulates a foreign object in the immediate vicinity of the bird, producing a startle reflex in the bird and causing it to flee. This response alerts and startles other birds in the area causing them to flee as well. The light can also be used to illuminate birds directly, causing them to look into the laser beam. The light produced in the eye of the bird creates an intense light pattern, making the distance to the light source difficult to determine, causing disorientation and confusion.

Figure 1:
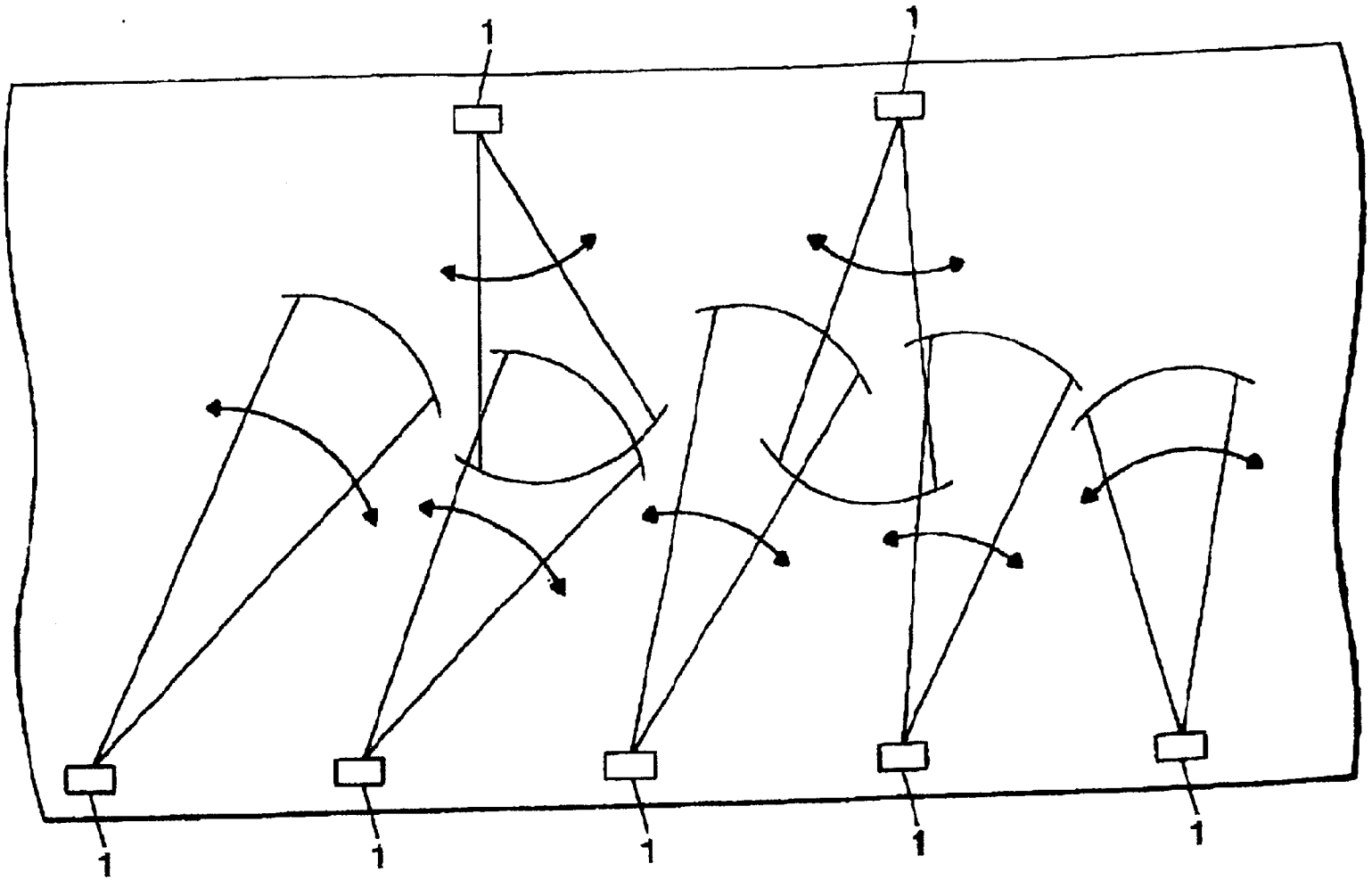
FIG. 1 is a schematic representation of a golf course, farm land and/or air field or the like which incorporates therein the present invention.

One embodiment of the present invention involves the dispersal of nuisance birds on golf courses, farmlands, airfields and the like. FIG. 1 shows one possible configuration of the laser device(s) 1 near a golf course lake where nuisance birds have congregated. The device can be used as a hand held device or automated for unmanned operation. FIG. 1 shows the laser device placed on the ground at a golf course in the immediate vicinity of the birds and is periodically activated to sweep the laser beam across the area of interest. Random motion and activation of the laser beam decrease the likelihood of habituation of the birds to become accustom to the high intensity light source.

Figure 2:
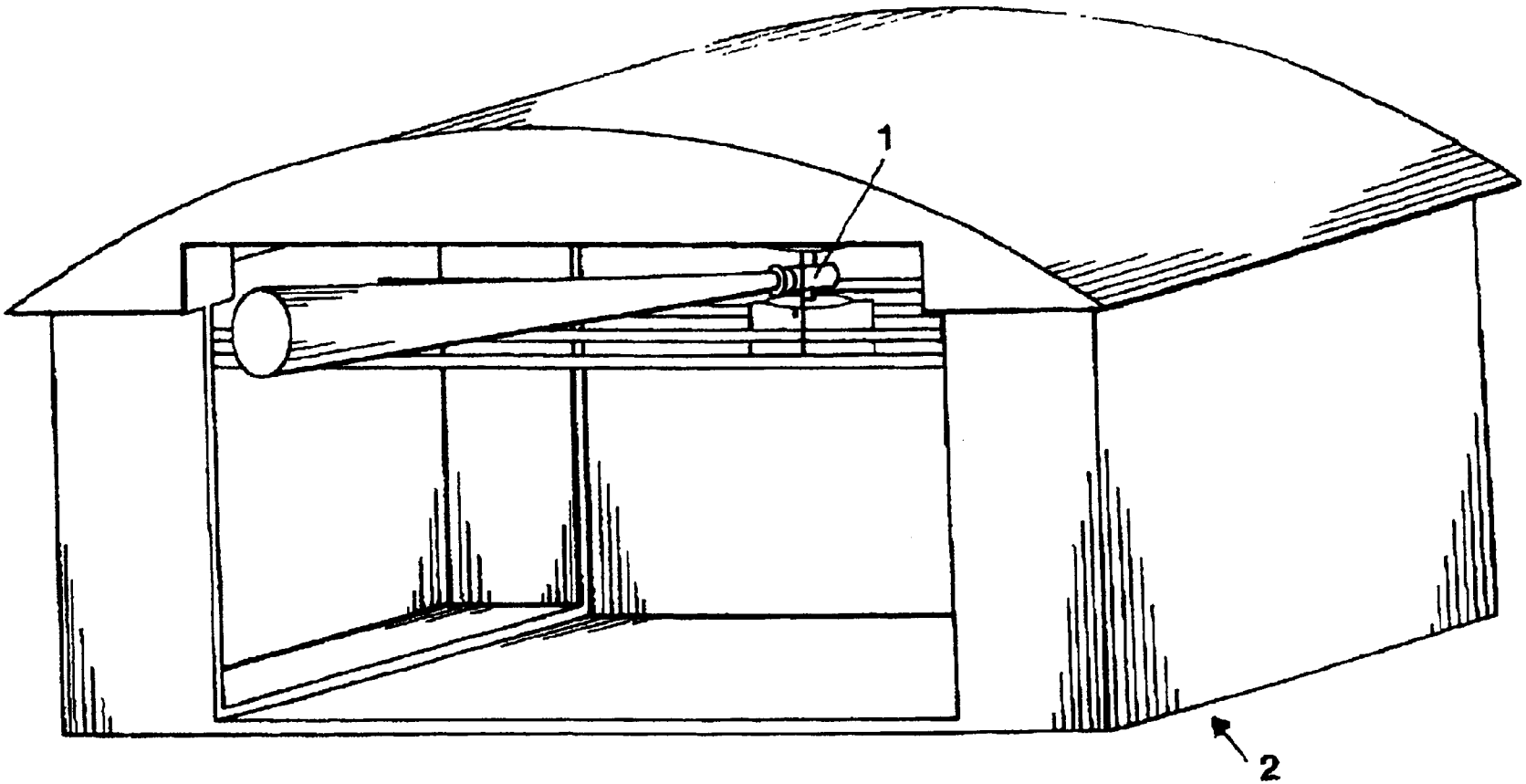
FIG. 2 is a schematic representation of a hanger, warehouse or the like which incorporates therein the present invention.

Another embodiment of the invention incorporates the use of the device(s) 1 in warehouses and airport hangers 2. This concept, shown in FIG. 2, and is utilized to keep birds from nesting or congregating in the rafters inside of structures. Once again the present invention can be used manually from the ground to illuminate and sweep birds out of the building or can be used in the unmanned automated configuration and placed inside the structure in the rafters. Typical operation in this scenario places a single device in the center of the building near the ceiling. At random or predetermined time intervals, the device is swept around the entire ceiling, removing or preventing birds from perching in the rafters. The precise control of the device allows for treatment of a specific area. In this particular case, the device can be directed to dispersing birds from the rafters and not affect normal activities of personnel on the ground. This same concept can also be used on rooftops to avoid nesting of birds in roof mounted mechanical equipment such as heating and cooling systems.

Figure 3:
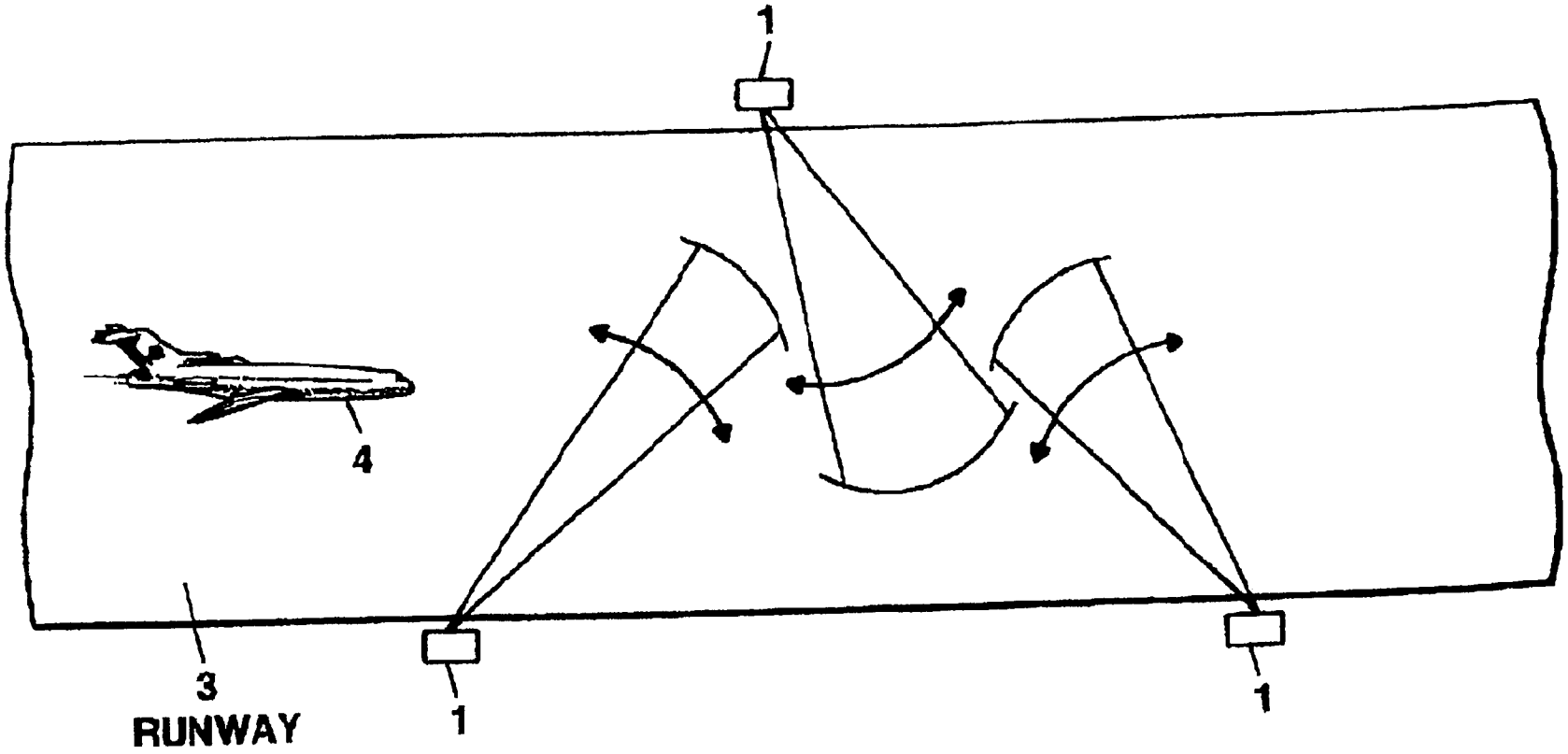
FIG. 3 is a schematic representation of a runway or the like which incorporates therein the present invention.

An additional embodiment of this invention involves the placing of a non-lethal light emitting device(s) 1 adjacent to airport runways 3 to reduce the potential of bird air strikes on planes 4 during take-off and landing. FIG. 3 shows the present invention placed on the ground near typical roosting or nesting areas near the airport. The device is directed to sweep only the area of interest and is directed toward the ground to ensure the device does not disrupt aircraft activities. The primary effect with this scenario is to create an undesirable area for birds to congregate and roost. Several devices may be necessary to effectively reduce bird populations.

Light emitting devices such as the type described in U.S. Pat. No. 5,685,636, U.S. Pat. No. 6,007,218 and U.S. patent application Ser. No. 09/409,328 all of which being incorporated herein by reference, utilize extremely bright light at predetermined wavelengths, beam diameters, intensities, and flashing patterns to create temporary visual impairment (by glare and/or flashblinding) to cause hesitation, delay, distraction, disorientation, and reductions in functional effectiveness of nuisance birds.

Another preferred embodiment of the present invention utilizes one or more light-emitting diodes (LEDs) in place of the laser for certain, short-range applications. Light-emitting diodes are non-laser semiconductor light sources that share a laser's ability to emit light of a specific wavelength. Recently several ultra-brightness Single LEDs (Gilway Technical Lamp Stock # E184—red, E903—green, E474—blue for example) and LED arrays (Opto Technology Stock # OTL-660A-9-4-66-E—red, OTL530A3-4-66-E—green, OTL-470A-3-4-66-E—blue for example) have become commercially available. The cost of such single LEDs and LED arrays is considerably less than that of a laser. By the utilization of LEDs and/or LED arrays and their associated circuitry within the device of the present invention, the present invention takes advantage of such cost savings.

Figure 4B:
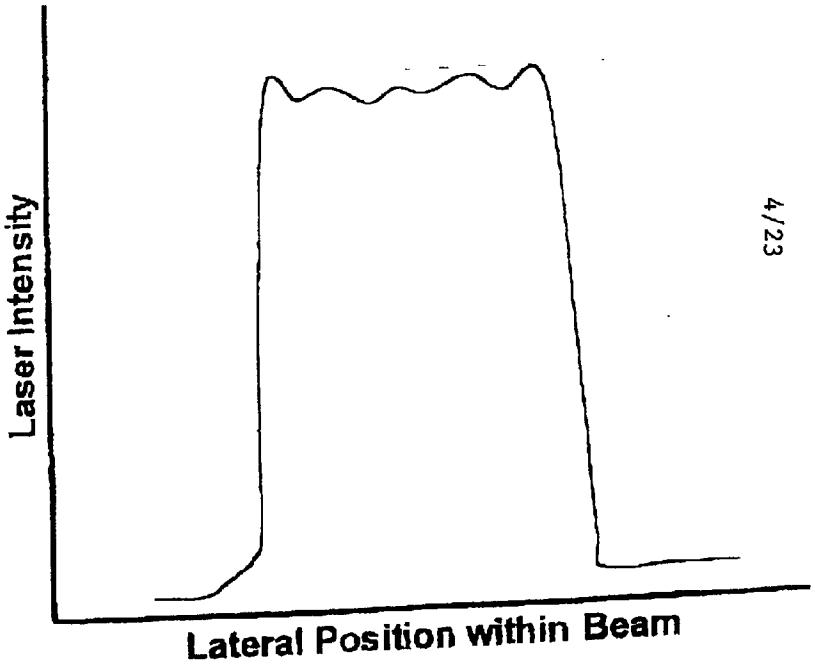
FIG. 4*b* is a graphic representation of a laser output beam having an intensity peak substantially flat across its entire diameter.
Figure 4A:
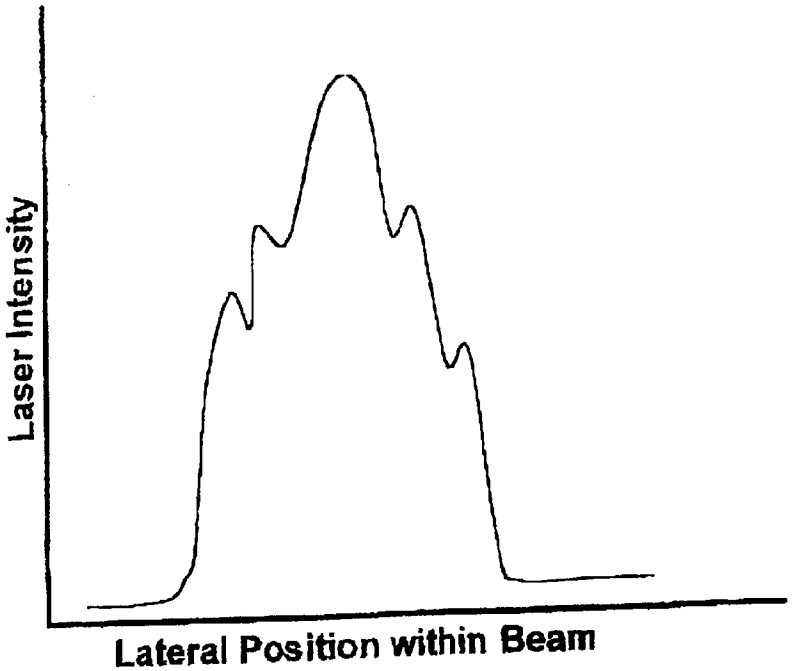
FIG. 4*a* is a graphic representation of a laser output beam having a strong central intensity peak.

The output beams produced by most lasers are not of uniform intensity throughout the beam area but rather have one or more "hot" spots. Within these hot spots, the light intensity can be several times brighter than the average intensity of the beam. The ideal laser beam for these applications would have a flat intensity profile throughout the entire beam area. FIGS. 4*a* and 4*b* of the drawings illustrate this point. The typical laser output beam of FIG. 1*a* has a strong central intensity peak. However, the laser beam of FIG. 1*b* is essentially flat across its entire diameter, allowing the laser output power and the brightness of the beam as seen by an adversary to be several times greater than the beam in FIG. 4*a*.

In some cases, within the bird dispersal methodology of the present invention, it is beneficial to alter the output pattern of a light source or light emitter in order to achieve illumination that is more uniform than otherwise possible from the light emitter. For example, typical semiconductor laser diodes emit light that is highly divergent in one direction and much less divergent in the perpendicular direction. The result is an illumination pattern that is rectangular, often 20 times wider in one direction (up and down, for example) than in the perpendicular direction (left and right, for example). In this case, in order to achieve more uniform illumination, it is beneficial to alter the output pattern by focusing the semiconductor laser diode's light into an optical fiber. Light emitted from the distal end of the fiber is then made more uniform by the physical properties of the optical fiber. The rectangular emission pattern of light emission from the semiconductor laser diode is altered, by focusing the light into an optical fiber and into a round and uniform illumination pattern. A more detailed description of the optical fibers and their relationship with the light sources is provided below with respect to FIGS. 5 through 7.

In the embodiment of the present invention related to the use of LEDs as a light source or light emitter, the light emitter output pattern is already relatively uniform. It should be realized that focusing the emitter's light into an optical fiber would still improve the uniformity of the illumination pattern. However, with such a relatively uniform emitter, it may be possible to achieve sufficiently uniform illumination without the use of an optical fiber.

A further preferred embodiment of the present invention utilizes at least two colors of light within the device to substantially improve the effectiveness when used to produce disorientation of birds in the flashing mode. By the incorporation within the device of electronic circuitry as described in detail with respect to FIGS. 10 and 11 of the drawings, to sequentially flash first one color light source then another color light source in repeated cycles, enables the disorientation affect to be significantly greater than that produced by a single-color on-off flashing light.

Figure 5:
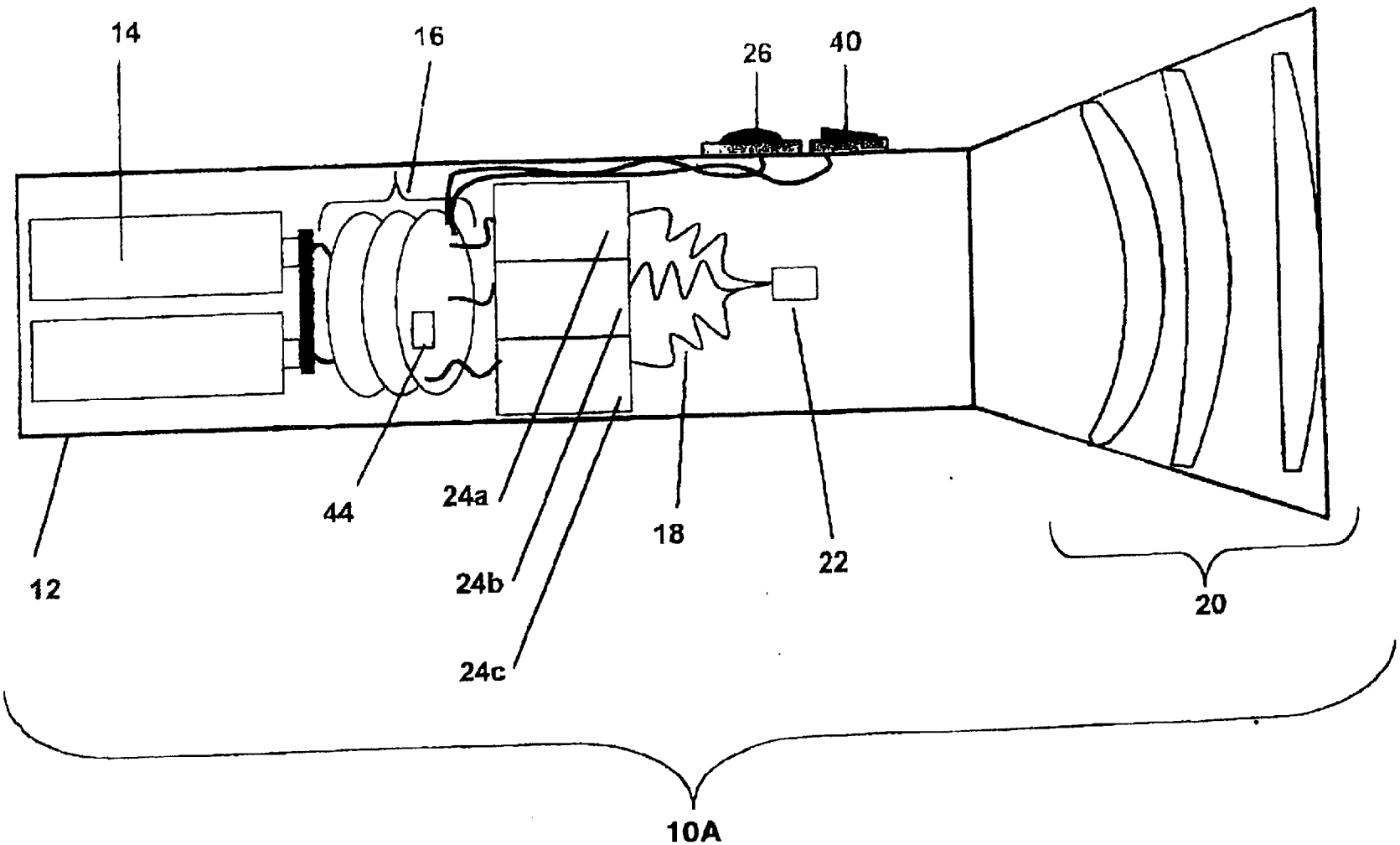
FIG. 5 is a schematic representation of a preferred embodiment of the present invention using multiple laser light sources.

Reference is now made to FIGS. 5–11 of the drawings for a more detailed description of the inventive embodiments where, for ease of understanding of the invention, like reference numerals will be used for substantially identical components. FIG. 5 of the drawings illustrates the preferred embodiment of the invention in the form of a handheld device or system 10A which incorporates therein the use of light sources of different wavelengths (or a single laser capable of multiple wavelengths. It should also be realized, however, that the present invention is not limited to hand-held devices.

As shown in FIG. 5, the various components of this invention are contained within a rugged housing 12. All components are contained within housing 12, preferably made of aluminum, which is also preferably sealed and weatherproof. The function of the housing 12 is to provide protection to the internal components and to provide a rigid structure for all optical and electronic components. Within the housing 12 reside power source 14, preferably in the form of batteries (although a DC power supply can also be used), multiple lasers, each laser emitting light of a different color. For example, laser 24*a* is preferably red in color (Applied Optronics Corporation, AOC-670-250-T3), laser 24*b* is preferably green in color (Casix, DPGL-1050), and, if desired, a third laser 24*c* is preferably blue in color. It is also possible to use even additional lasers of different colors. Each laser is aligned into respective coiled optical fibers 18 (for example, Mitshubishi, SK-10 Optical Grade Fibers). A fiber coupling unit 22 (for example, Thor Labs, Inc., 10770A, SMA Connector) serves to bring the multiple coiled fibers 18 to a single output point. Any suitable optical lens assembly 20 (for, example, Lens 1 Optimax Corporation, Custom Spherical, Lens 2 Optimax Corporation, Custom Spherical, Lens 3 Newport Corporation, KPX-232) shapes the beam, provides uniform intensity distribution, and collimates the beam. The optical lens assembly 20 preferably has some adjustablility in order to obtain a desired spot size for the particular application. This adjustablility feature is described in U.S. Pat. No. 6,007,218. The device 10A is activated using a momentary ON/OFF activation switch 26 located on the outside of housing 12 in a manner similar to that described in U.S. Pat. No. 5,685,636 and U.S. patent application No. 6,007,218. A multi-position switch 40 is used to select which laser or lasers will be activated in a manner as set forth in detail below.

Figure 10:
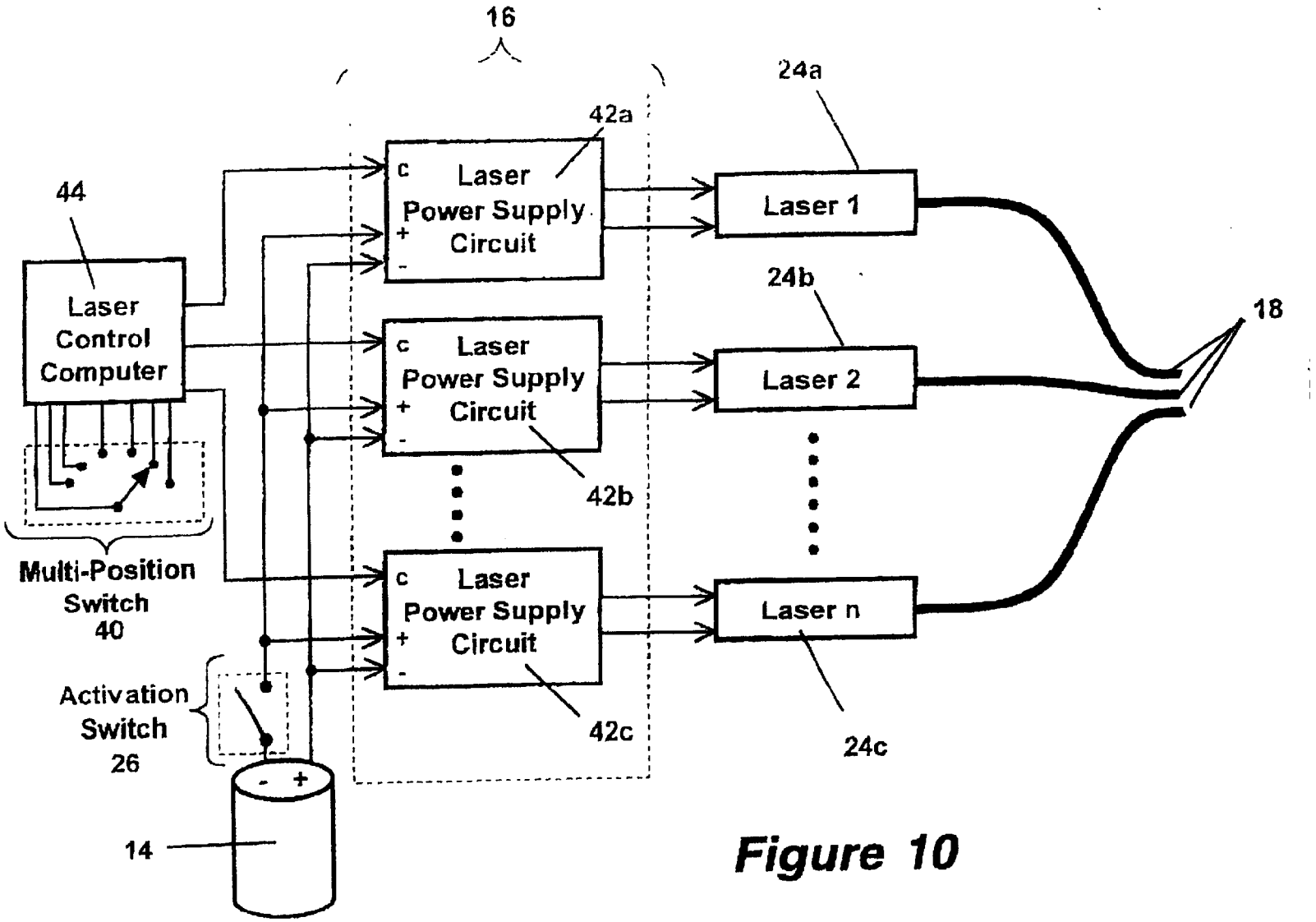
FIG. 10 is a schematic representation of the electronics and control circuitry used to power multiple lasers.
Figure 11:
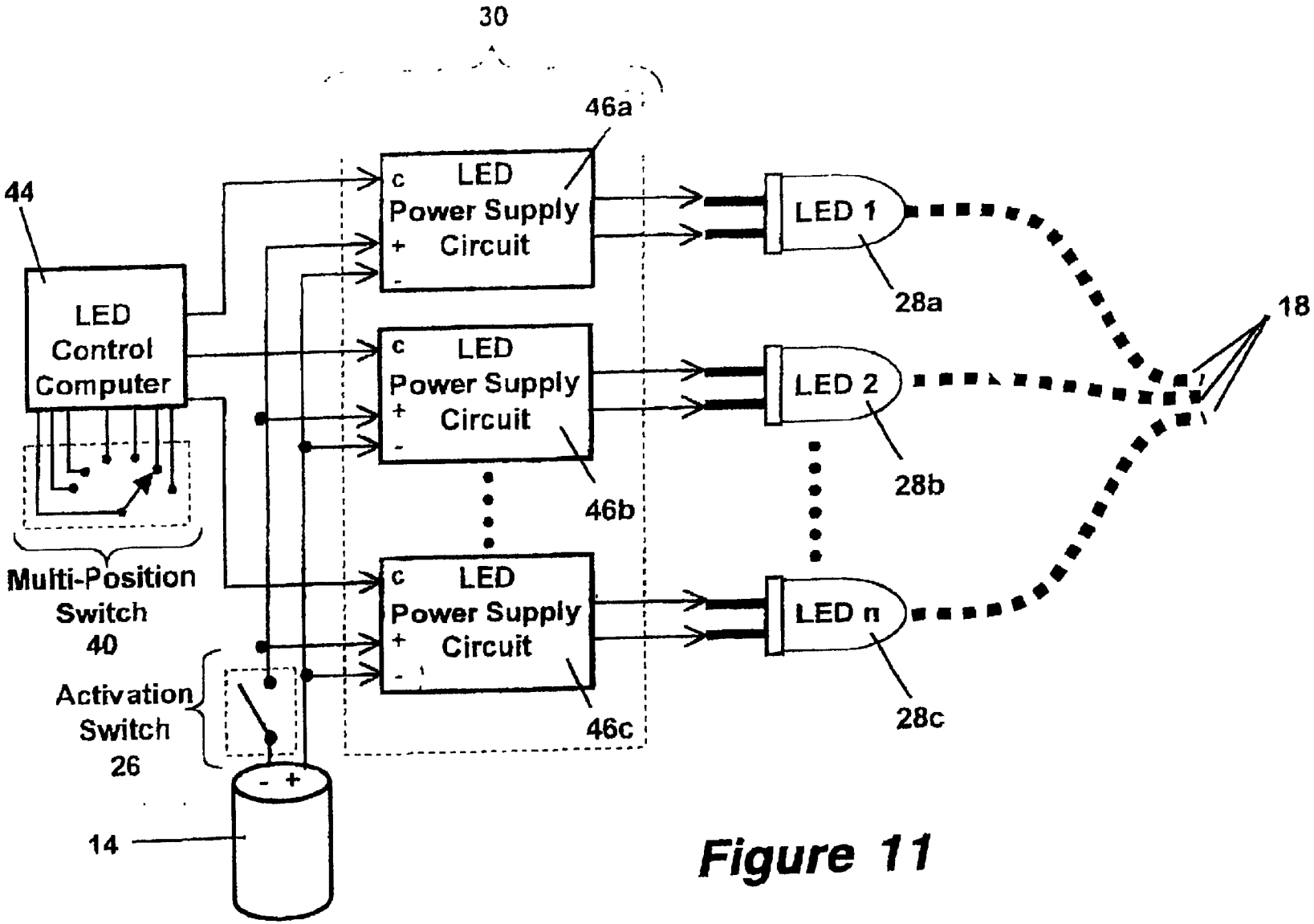
FIG. 11 is a schematic representation of the electronics used to drive multiple LEDs.

All of the embodiments of the present invention are capable of activating several modes using the multi-position switch 40 and the momentary ON/OFF switch 26 and the control computer 44 (described in more detail with respect to FIGS. 10 and 11. One mode of operation would allow continuous ON mode for one or more of the selected light sources. For example, red green, or blue light sources would be emitted continuously from the device. Additionally, another mode of operation would allow for flickering (blinking) of one or more selected light emitting sources. For example, red, green or blue light sources flickering at the same time (in phase). Another mode would involve flickering selected light sources in an offset manner, perhaps completely out of phase from each other. For example, red and green light sources flickering at the same frequency such that the red source is ON while the green source is OFF, so that light emitted from the device alternates red, green, red, green, etc. Also, another mode of operation would consist of flickering selected light sources at different frequencies. For example, a red source flickers 8 times per second, a green source flickers 12 times per second and a blue source at 16 times per second. Finally, any number of modes consisting of a combination of those just described. For example, a blue light emits continuously while red and green sources flicker (either at the same time, or offset, or at different frequencies).

In the present invention multi-position switch 40 is capable of activating the modes described above. For example, continuous ON mode for all lasers 24*a*, 24*b*, 24*c*, continuous ON mode for selected lasers, such as 24*a*, 24*b*, flicker (or blinking) mode for all lasers 24*a*, 24*b*, 24*c*, and flicker mode of only select color lasers 24*a*, 24*b*, 24*c* at various flicker frequencies. In addition, the flicker mode of operation could also be controlled with the momentary ON/OFF switch 26 by incorporating a delay or timer circuit. In this scenario, if the momentary ON/OFF switch 26 is activated, continuous light may be emitted from the beam for 5 seconds, and then the device would automatically engage flicker or flashing mode. Depressing of the momentary ON/OFF activation switch 26 activates the device or system 10A once a setting has been selected with the multi-position switch 40. It would also be desirable to change the multi-position switch 40 while the main momentary ON/OFF switch 26 is engaged. With the present invention, a flash rate of approximately 8 Hz provides optimal disorientation for on-off flashing. If the light is flashed between two colors in different parts of the visible spectrum (red and green or red and blue for example) rather than on and off, the disorientation is enhanced because the eye is trying to adapt.

Still referring to FIG. 5, each laser 24*a*, 24*b*, 24*c* has a respective coiled optical fiber 18 associated with it. The optical fibers 18 are aligned with their respective laser 24*a*, 24*b*, or 24*c* to provide good optical throughput. The fibers are coiled into multiple loops in order to "mix-up" or "homogenize" the output beam. Reference is made to U.S. Pat. No. 6,007,218 for additional fiber coiling information. This coiling also keeps the intensity profile of the output beam to be very nearly constant throughout the beam area as shown in FIG. 4*b*. The output end of the coiled fibers 18 are assembled into a conventional coupling device 22 which is mounted near the focal point of the optical lens assembly 20.

Figure 6:
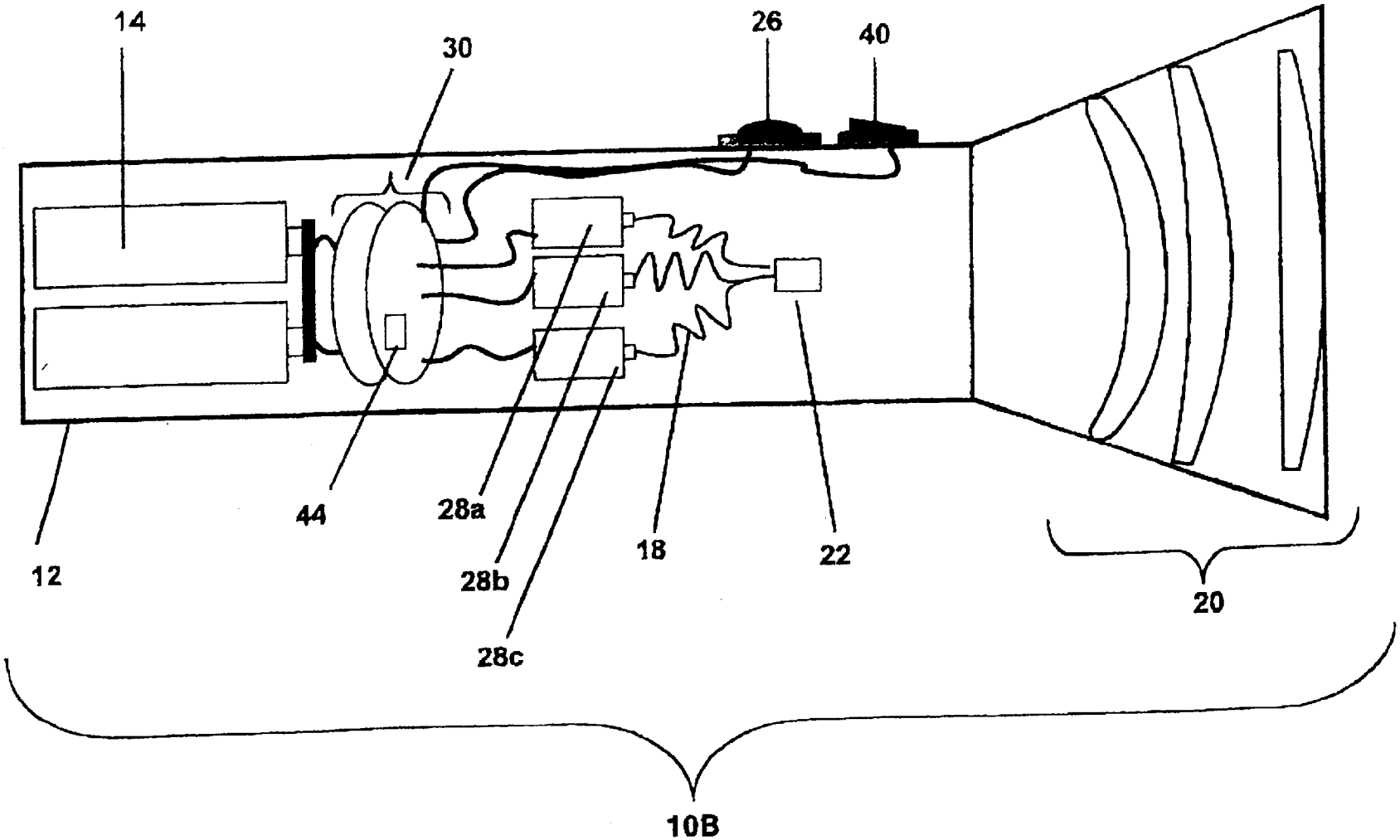
FIG. 6 is a schematic representation of another embodiment of the present invention using multiple light-emitting diodes (LED) light sources.
Figure 8:
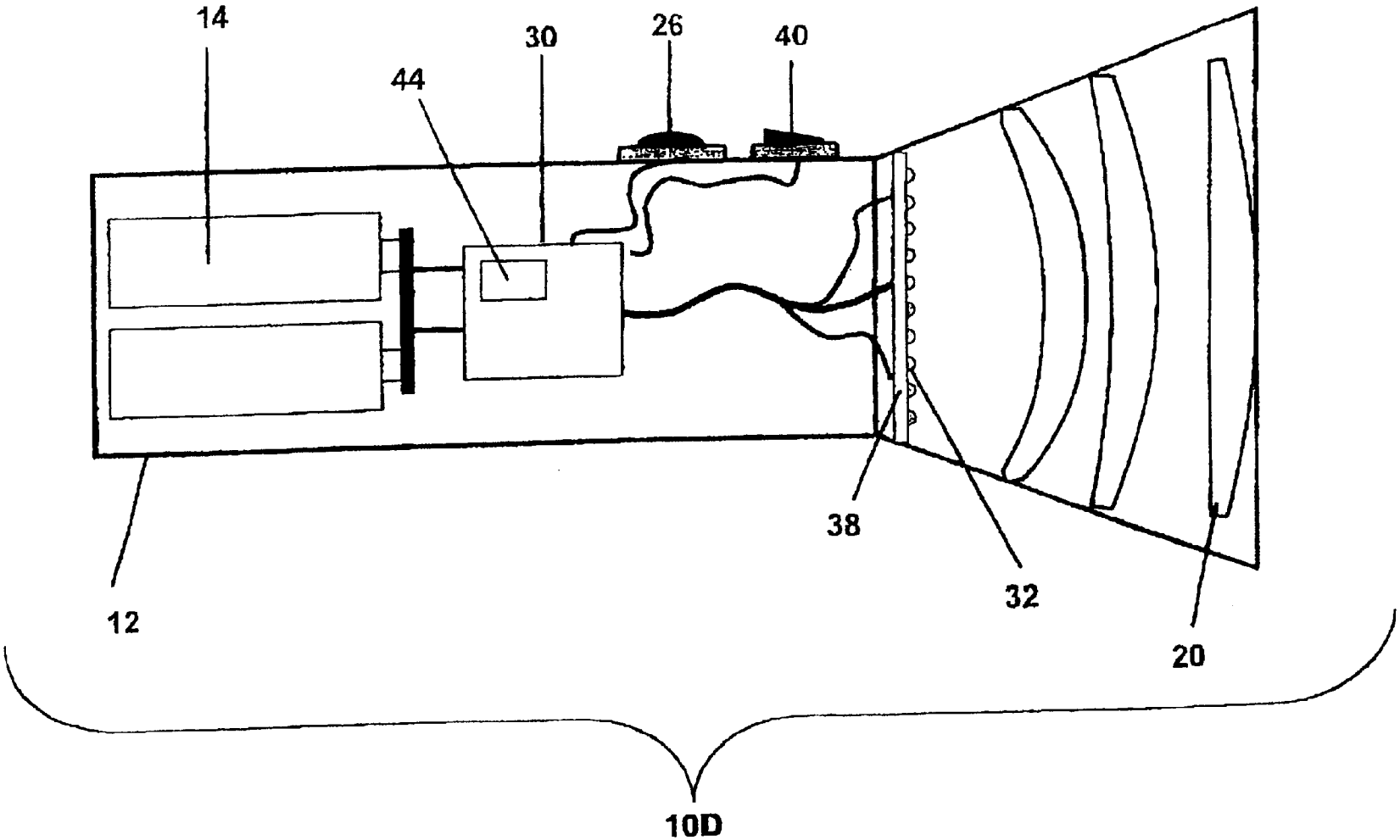
FIG. 8 is a schematic representation of a further embodiment of the present invention using an LED array.

FIG. 6 shows a variation of the preferred embodiment of FIG. 5 in which security device or system 10B uses multiple LEDs 28*a*, 28*b* and 28*c* in place of the multiple lasers 24*a*, 24*b* and 24*c*, respectively. Contained within housing 12 are multiple LEDs 28*a* (preferably red in color, OptoTechnology OTL-660a-3-466E or Gilway Technical Lamp, E184), 28*b* (preferably green in color, OptoTechnology OTL-530a-9-4-66E or Gilway Technical Lamp, E903), and 28*c* (preferably blue in color, OptoTechnology OTL-4703-4-66E or Gilway Technical Lamp, E474). The LEDs 28*a*, 28*b*, and 28*c* may be fiber coupled using a coiled optical fiber 18 for each LED. Also, the LEDs could be arranged in an array 32 as shown in FIG. 8. Still referring to FIG. 6, the LEDs 28*a*, 28*b*, 28*c* are aligned with each coiled fiber 18, respectively. Coiling is necessary if beam shaping is needed. If the unmodified output of the LED is "round" or uniformly shaped, it may not be necessary to use a coiled fiber. However, if space inside a housing 12 is limited, fibers may be used to "guide" the beam location where it may be imaged. Once coiled, the fibers 18 are polished. Polishing of fibers is commonly accomplished by sanding the fiber face with sequentially higher grit sandpaper until the desired finish is attained. Once polished, the fibers 18 are collected together in a conventional fiber coupling device 22. Any suitable optical lens assembly 20 is used to shape the beam for a variety of uses. A lens assembly 20 that diverges the beam quickly may be useful for short-range applications, and a lens assembly 20 that has a small divergence or is collimated is preferred for long range applications. Adjustment in the placement of the lens assembly 20 may be desirable in order to have additional options of spot size. A momentary ON/OFF switch 26 and multi-position switch 40 are used to activate the device or system 10B in a variety of modes as discussed above with respect to the embodiment of FIG. 5.

It is important to note that the electronics 30 (described in detail with respect to FIG. 11) used to drive the LEDs 28*a*, 28*b*, and 28*c* is very simplified from the circuitry used with the lasers. LEDs are easy to power with only batteries 14 and a simple voltage regulator integrated circuit and associated resistors and capacitors while the circuitry of electronics 16 requires sophisticated power supply circuitry. LEDs are cost effective and have a long, stable lifetime, therefore a monitor photodiode or other sophisticated electronics are not needed. Less sophisticated electronics along with low LED prices make this embodiment very cost effective for short range applications.

Figure 7:
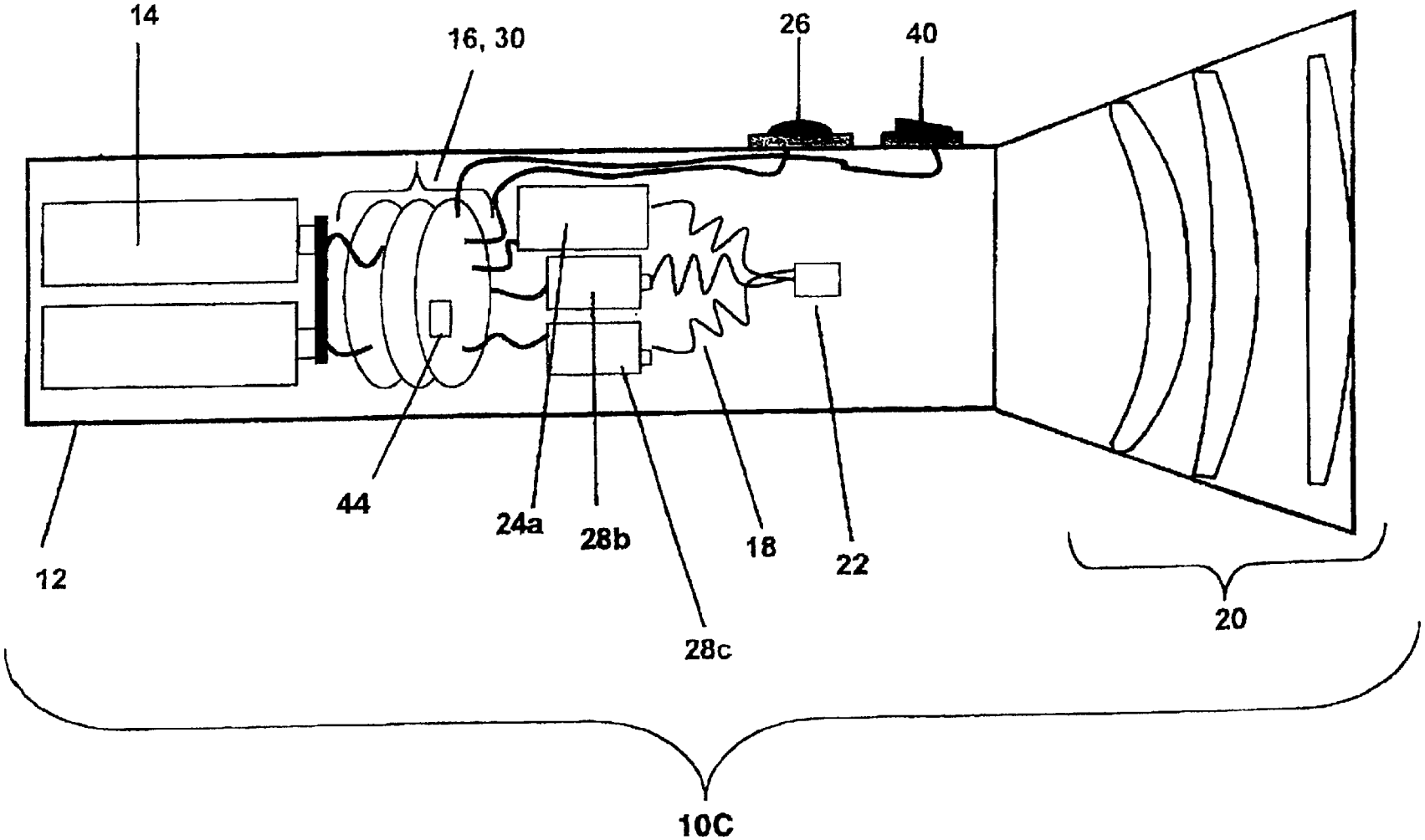
FIG. 7 is a schematic representation of still another embodiment of the present invention utilizing a hybrid laser/LED light source.

FIG. 7 depicts a hybrid version of the invention as embodied in device 10C in which both a laser 24*a* and LEDs 28*b*, 28*c* are used to provide an effective bird dispersal device, although the exact combination of lasers and LEDs may vary within the scope of this invention. This embodiment of the invention is desirable in order obtain a good mix of output power with cost effectiveness. Preferably laser 24*a* is red in color, small, compact, and commonly available. LEDs 28*b*, and 28*c* provide green and blue light, respectively. All of the light sources 24*a*, 28*b*, and 28*c* may be coupled with respective optical fibers 18 and brought together at a fiber coupling device 22. Once again, any suitable optical lens assembly 20 gives beam shaping capabilities to the output beam(s). The electronics 16 are moderately sophisticated, a portion of the electronics 16 must be able to provided constant current to the laser 24*a* (such as laser power supply circuit 42*a* as shown in FIG. 10). The LED electronics 30 needed to supply power to the light sources 18*b* and 28*c* require only simple voltage regulator integrated circuits (such as shown by the LED power supply circuits in FIG. 11) in order to operate within specification. The batteries 14 provide power to the device 10C. A momentary ON/OFF activation switch 26 activates the device 10C. The device 10C can be activated in several modes including both continuous and flicker of one or more light sources 24*a*, 28*b*, and 28*c* using the multi-position switch 40. This embodiment of the invention is very versatile and provides effective long and short range capability.

FIG. 8 of the drawings depicts another embodiment of the preferred embodiment. The light source in the device 10D of this embodiment is in the form of an array of LEDs 32 mounted to a base such as a printed circuit board (PCB) 38. This embodiment of the invention is simply powered by the batteries 14 and electronics module 30 of the type described with reference to FIG. 2 above and FIG. 8 below. Once again any suitable optical lens assembly 20 may be used to shape or focus the output beam. A momentary switch 26 provides activation to the system 10D in a variety of modes as described hereinabove.

Figure 9:
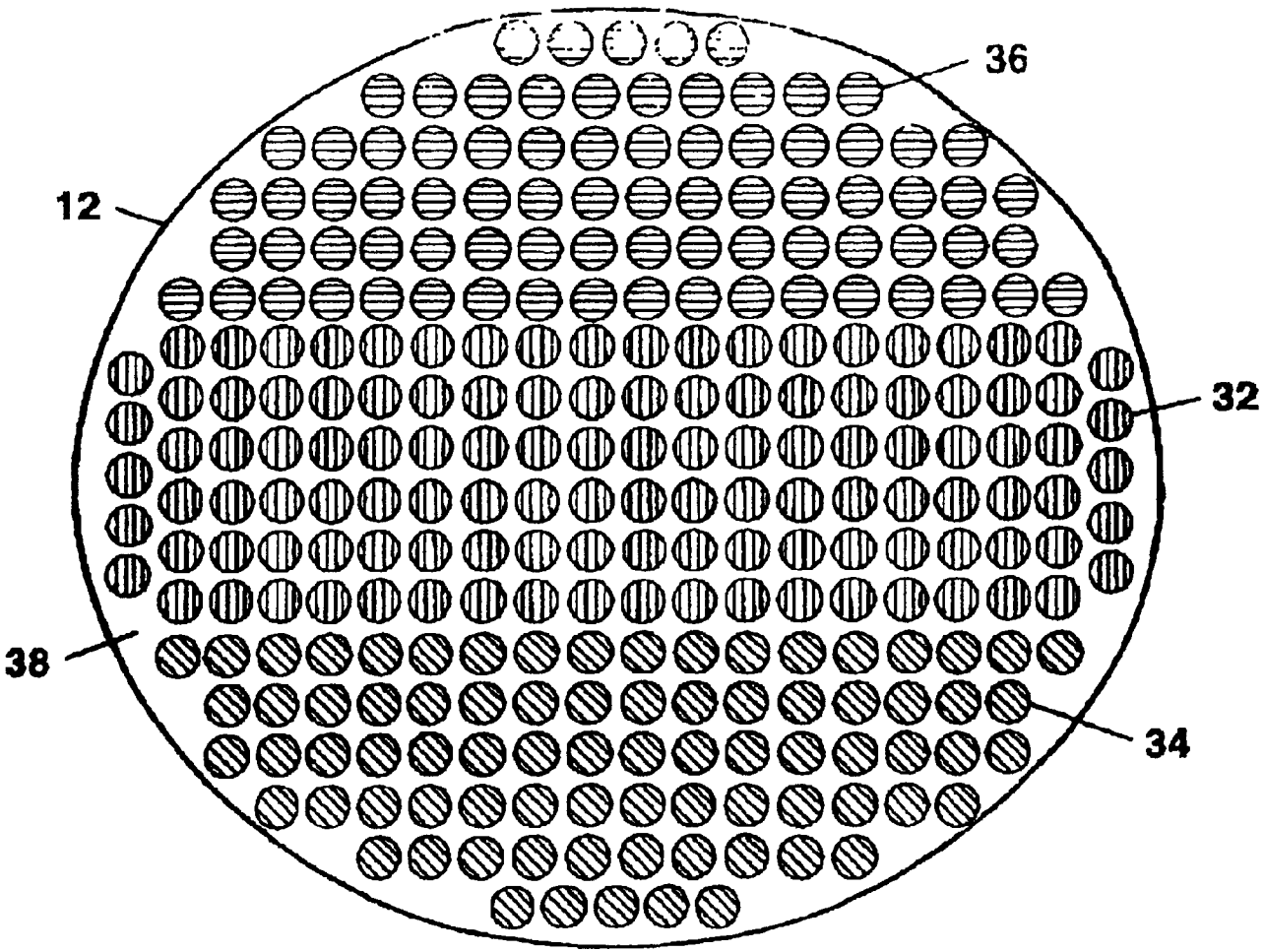
FIG. 9 is a front view of the LED array utilized in the embodiment of FIG. 8.

FIG. 9 illustrates a front view of the LED array 32 used in the above embodiment. An array 32 of multicolored LEDs (red), 34 (green), 36 (blue) are mounted on the base 38. This array 32 is then mounted into the housing 12. An optical lens assembly (not shown in this figure) may be needed to shape the outcoming beam.

Reference is now made more specifically to the electronics 16 and 30 utilized within the various embodiments of this invention. FIG. 10 is a schematic of the electronic circuitry 16 that provides for sequentially flashing multiple lasers. A separate laser power supply circuit 42*a*, 42*b* and 42*c* powers each laser 24*a*, 24*b* and 24*c*, respectively. Each of the power supply circuits 42*a*, 42*b* and 42*c* is preferably identical in design to the Laser Diode Switching Power Supply Circuit in U.S. Pat. No. 5,685,636 and U.S. Pat. No. 5,685,636, both of which as stated above being incorporated herein by reference. The power supply circuits 42*a*, 42*b*, and 42*c* provide the well-regulated, constant-current electrical power required for safe operation of semiconductor laser diodes. A laser control computer 44 utilizing, for example, an inexpensive Programmable Integrated Circuit (PIC) (Microchip Technology, Inc., PIC12CE67X), provides individual ON/OFF control signals to the control input pins of the multiple power supply circuits 42*a*, 42*b*, and 42*c*. The PIC (not shown) contained within the laser control computer 44 is programmed to provide the appropriate ON/OFF control signals in response to a multi-position switch 40, which is set by the user to select operating modes. Battery power 14 provides DC electrical power to the laser power supply circuits 42*a*, 42*b*, and 42*c* and the laser control computer 44 whenever the momentary ON/OFF activation switch 26 is depressed by the user to activate the security device 10A.

FIG. 11 is a schematic of the electronic circuitry 30 that provides for sequentially flashing multiple LEDs. The operation of the LED control circuit 30 is basically identical to that described for the multiple laser control circuit 16 shown in FIG. 10. As with circuitry 16, a PIC based control computer 44 is programmed to provide the appropriate ON/OFF control signals in response to a multi-position switch 40 whenever the momentary ON/OFF activation switch 26 is depressed. However, it is important to note that the LED power supply circuits 46*a*, 46*b*, and 46*c* differ from the laser power supply circuit 42*a*, 42*b*, and 42*c* of FIG. 10. The lasers (24*a*, 24*b*, and 24*c* shown in FIG. 10) require a complex switching power supply to provide a constant current. The LEDs, however, require only simple voltage regulator integrated circuits 46*a*, 46*b*, and 46*c* (Micrel Semiconductor, MIC2951), respectively. Such voltage regulator integrated circuits are very inexpensive, usually costing substantially less than the laser power supply circuits 42*a*, 42*b*, and 42*c*. The power supply cost difference, when combined with the very large cost difference between laser diodes and LEDs, provides embodiments of the present invention which are economically attractive.

Figure 12:
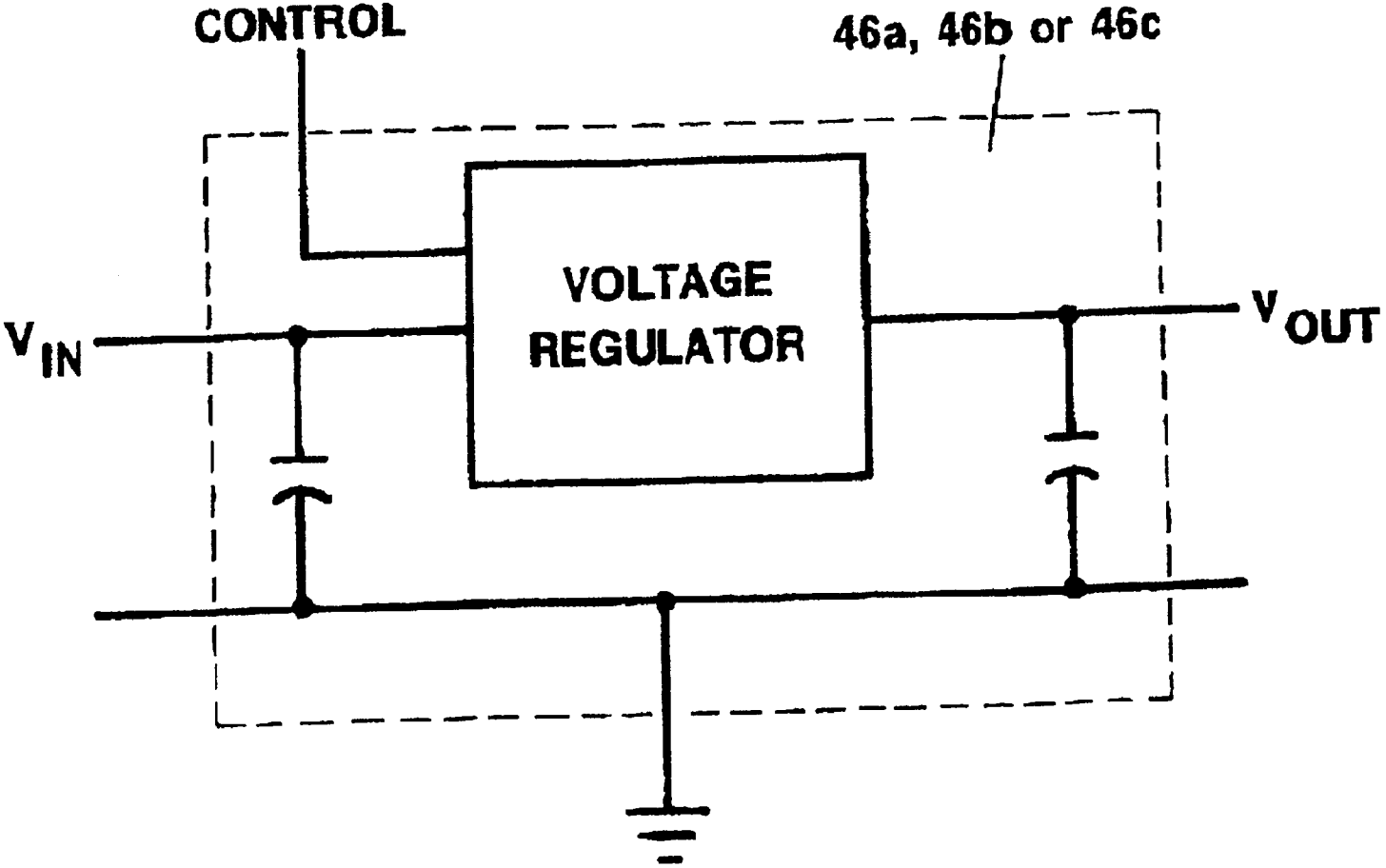
FIG. 12 is a schematic representation of the LED power supply circuit.

FIG. 12 is a schematic of the LED power supply circuit 46*a*, 46*b*, or 46*c* that provides operation of the LEDs. A simple commercial-off-the-shelf (COTS) voltage regulator circuit provides the electronics with a voltage in, voltage out, control signal, and common ground. This circuit is highly simplified from the laser power supply circuit (42*a*, 42*b* or 42*c*) and the laser power supply circuitry depicted in U.S. Pat. No. 5,685,636.

Figure 13:
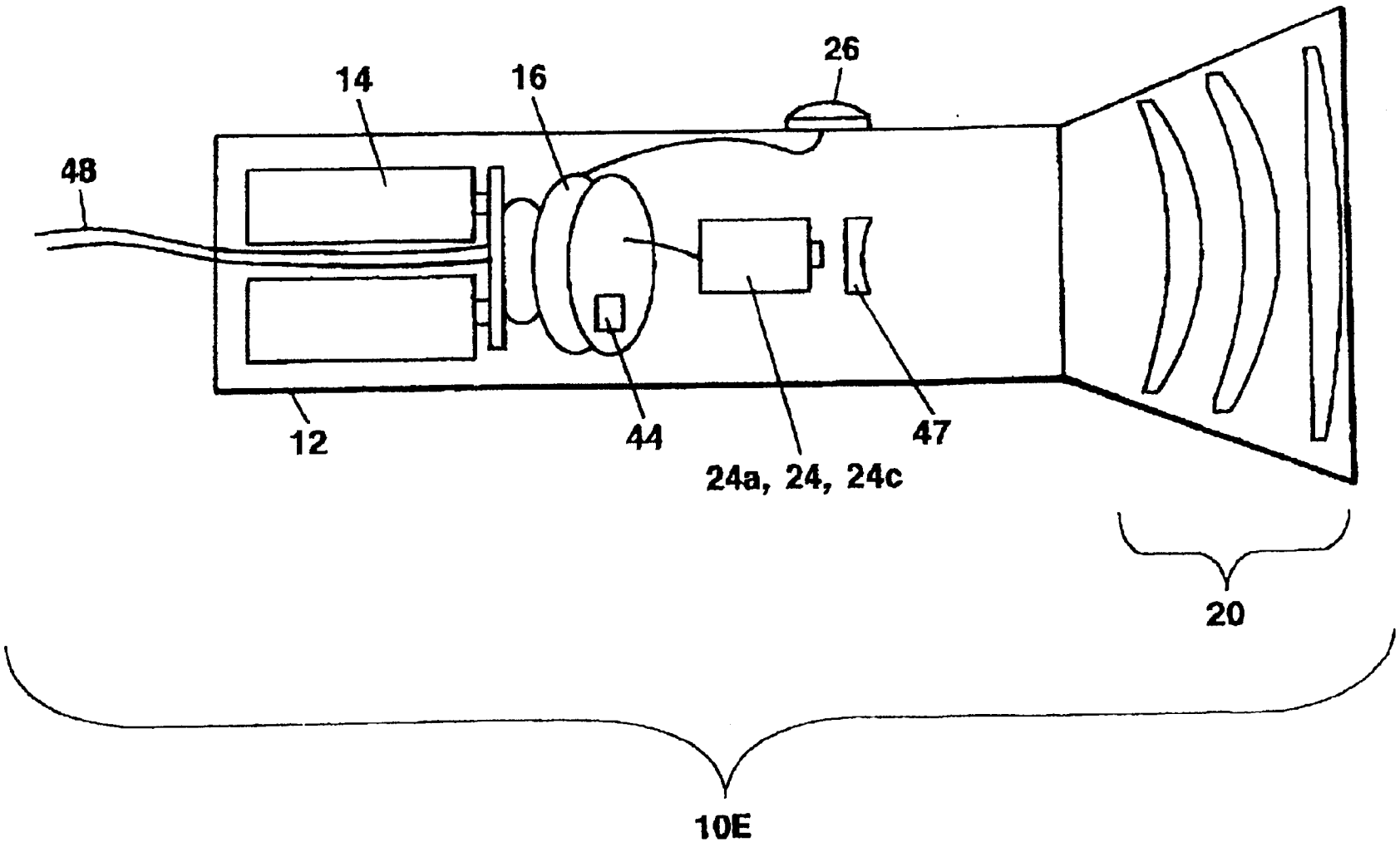
FIG. 13 is a schematic representation of still another embodiment of the present invention for direct coupling of laser diode to produce a laser beam.

FIG. 13 of the drawings depicts another embodiment of the preferred embodiment of the bird dispersal contained within rugged housing 12. The light source in the device 10E of this embodiment is in the form of a single laser 24*a*, 24*b*, or 24*c*. The light output of laser 24*a*, 24*b*, or 24*c* is simply projected through beam expanding lens 47 in place of fiber coupling. It should be noted that the beam expanding lens 47 may be either positive or negative in optical power. Once again any suitable optical lens assembly 20 may be used to shape or focus the output beam. This embodiment of the invention is simply powered by the batteries 14 or external power supply via DC power leads 48 and electronics 16 of the type described with reference to FIG. 5 above. A momentary switch 26 provides activation to the system 10E in a variety of modes as described hereinabove. The system 10E may also be activated by computer control 44.

Figure 14:
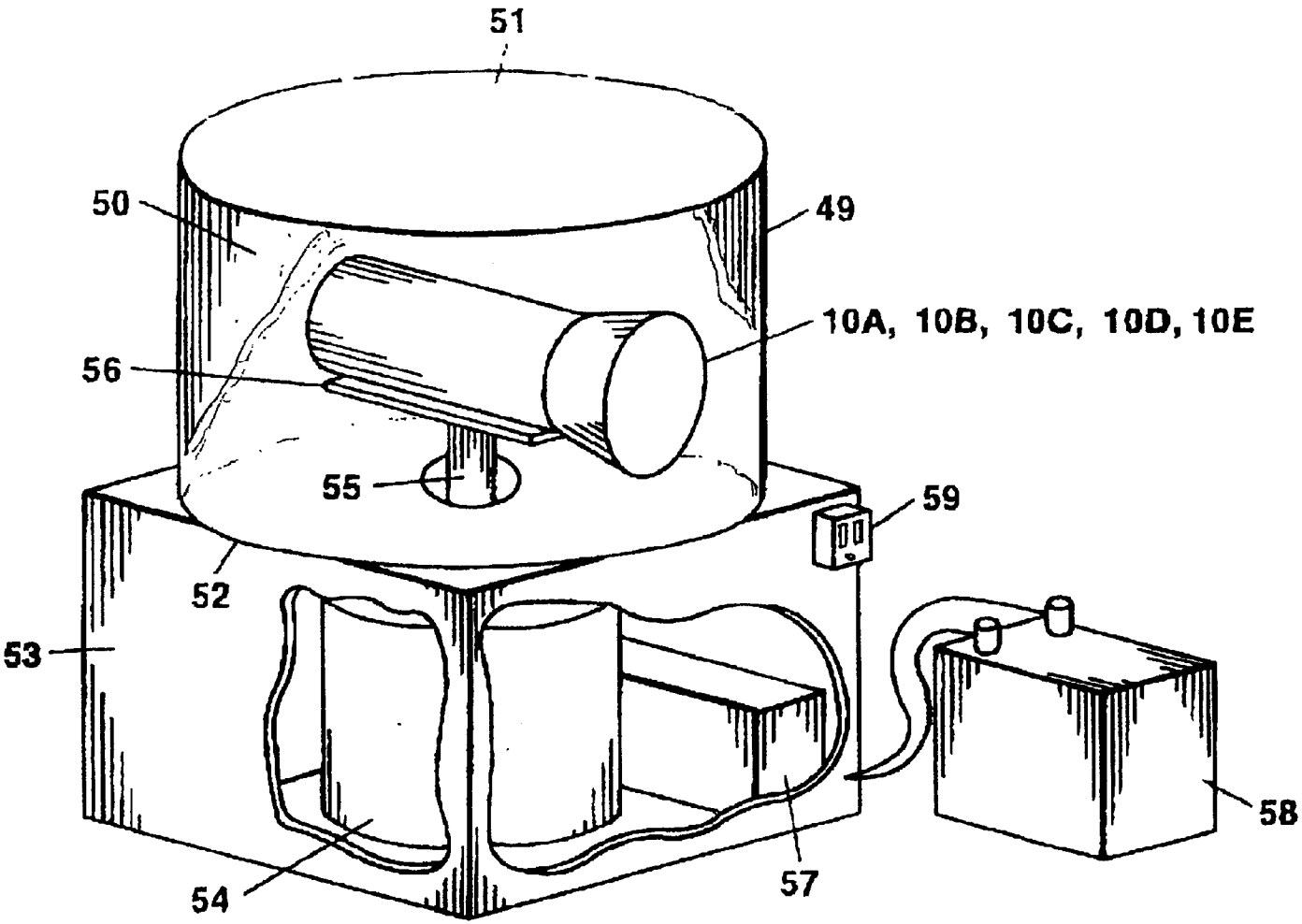
FIG. 14 is a schematic representation of still another embodiment of the present invention for utilizing an automated scanning system.

FIG. 14 of the drawings depicts still another embodiment of the invention. This embodiment of the invention depicts device 10A, 10B, 10C, 10D, or 10E mounted inside rugged container or housing 49. Rugged container or housing 49 is comprised of a cylindrical section of a larger diameter tube 50 preferably, but not limited to, polycarbonate enclosed by end plates 51 and 52. Polycarbonate tube 50 is of suitable diameter to contain and mount devices 10A, 10B, 10C, 10D, or 10E and is clear in color allowing light to project from the device through the tube wall. The rugged container 49 is mounted to any suitable motor enclosure 53. Motor enclosure 53 contains a computer-controlled motor 54 with drive shaft 55 extending into, but not through rugged container 49. Devices 10A, 10B, 10C, 10D, or 10E are mounted to drive shaft 55 via device mount 56. When activated, the motor 54 rotates drive shaft 55 and the device in a random or predetermined manner, such as scanning. The motor 54 is controlled via computer control 57 and is externally powered by battery 58 or any available AC power supply via AC power plug 59.

Figure 15:
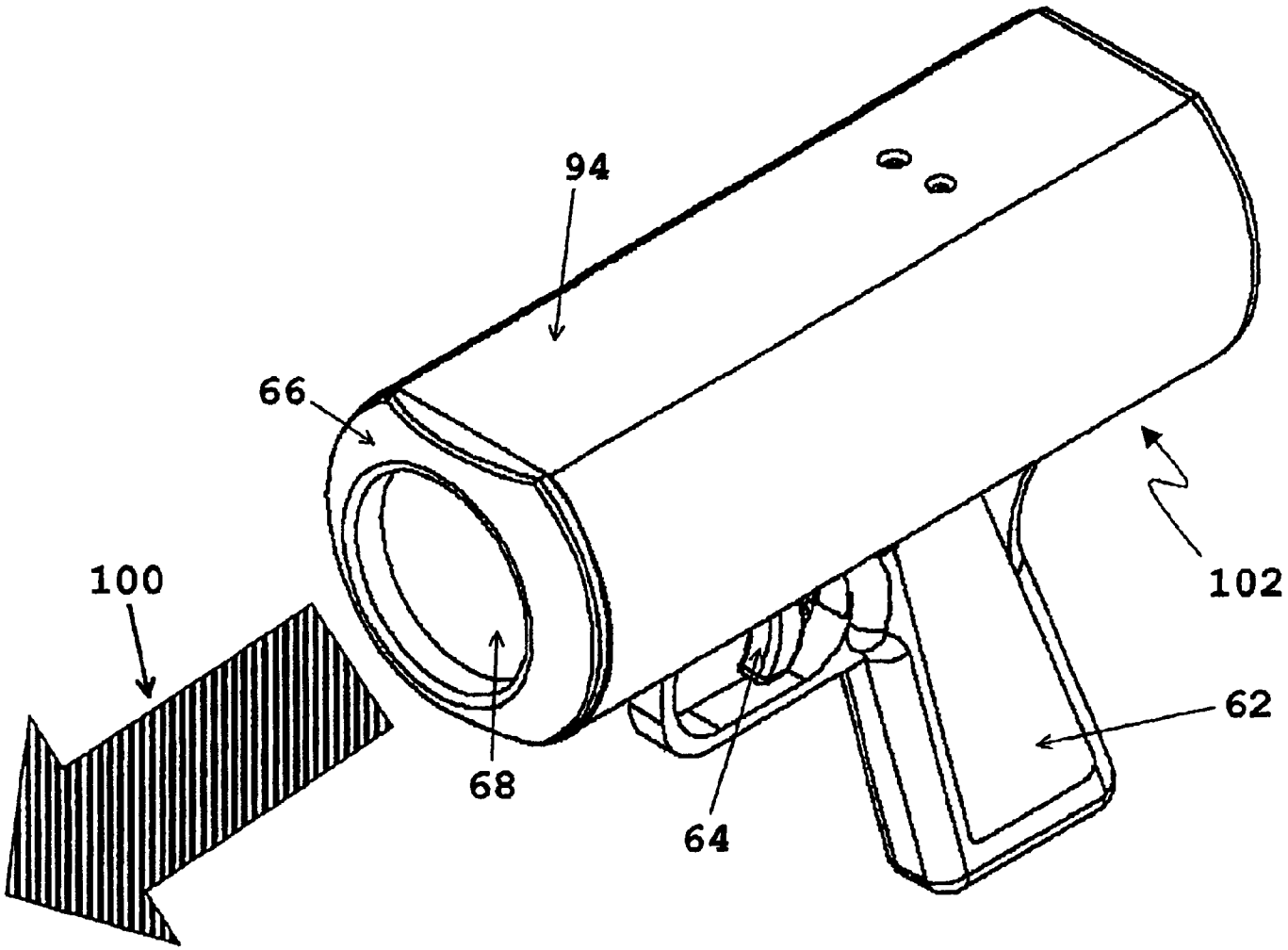
FIG. 15 is a perspective view of an alternative embodiment in the form of a hand-held device.
Figure 16:
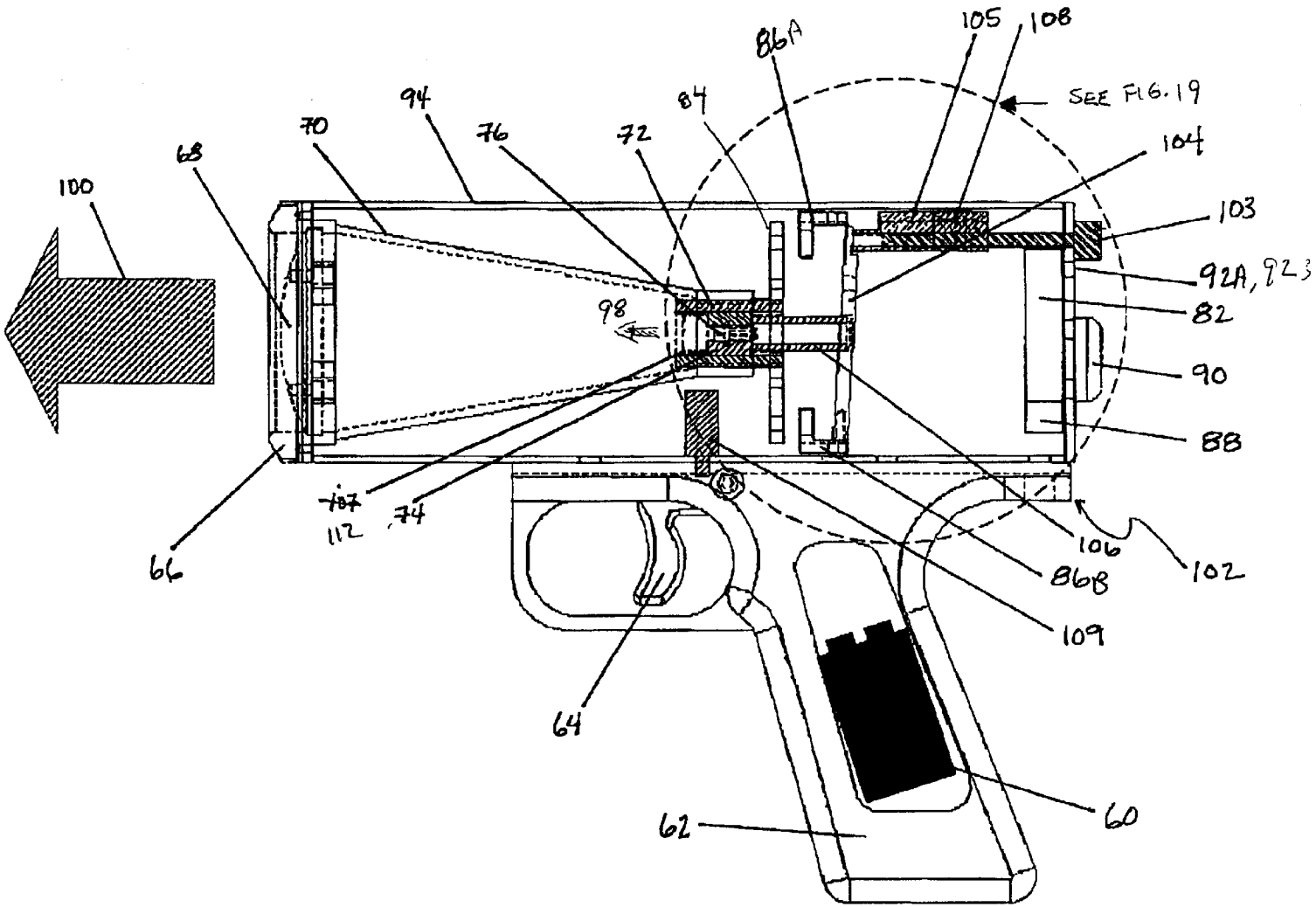
FIG. 16 is a cross-section view of the alternative embodiment of FIG. 15.
Figure 17:
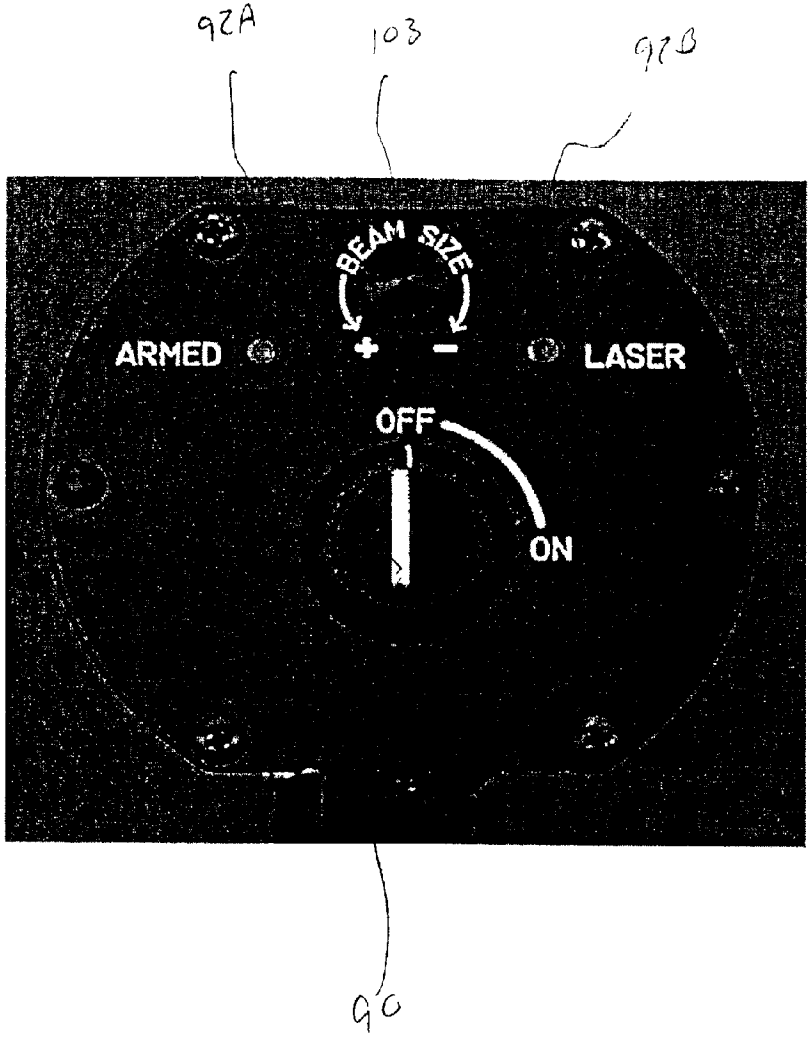
FIG. 17 is a photograph of the back panel of the handheld device of FIG. 15.
Figure 18:
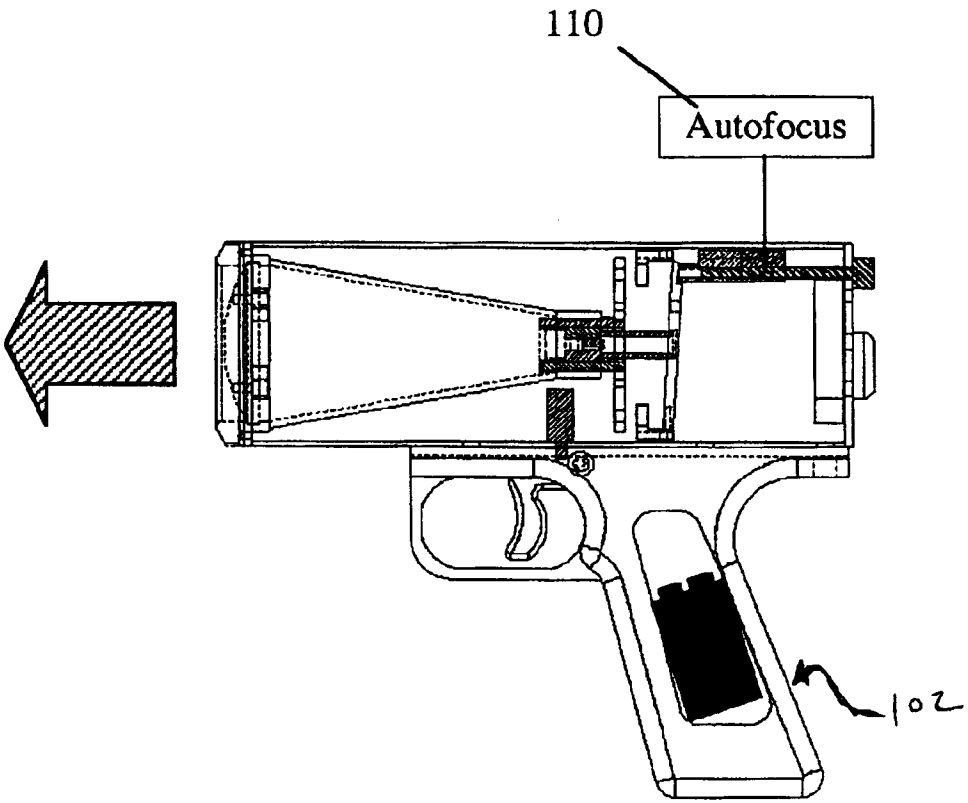
FIG. 18 is a cross-section view of the hand-held device of FIG. 15 operably connected to an autofocus device for adjusting light beam diameter.

FIGS. 15, 16 and 17 illustrate another embodiment 102 of the present invention in the form of a hand-held device. The components of this embodiment include: a power source, for example a battery 60, hand grip 62 with manual trigger 64, a trigger switch 109, optical front cover 66, collimating optical system 68, lens cone 70, laser diode heat sink/collimation adjustor 72, laser diode mount 74, laser or light emitting diode 76, laser diode power supply 82, anchor plate 84, upper clamping bracket 86A, lower clamping bracket 86B, safety interlock electronics 88, key switch interlock 90, an armed light-emitting diode (LED) status indicator 92A, a laser LED status indicator 92B, and a beam adjustment mechanism (to be discussed in detail below), and a housing 94. Through the following description uses the terms laser and bright light in referring to the light emitted from the present invention, it is understood that laser and any non-laser bright light are used interchangeably to mean any bright light. The beam adjustment mechanism is preferably a manually operated mechanical system, however, the present invention can be operably connected to an autofocus 110, as illustrated in FIG. 18.

Figure 19:
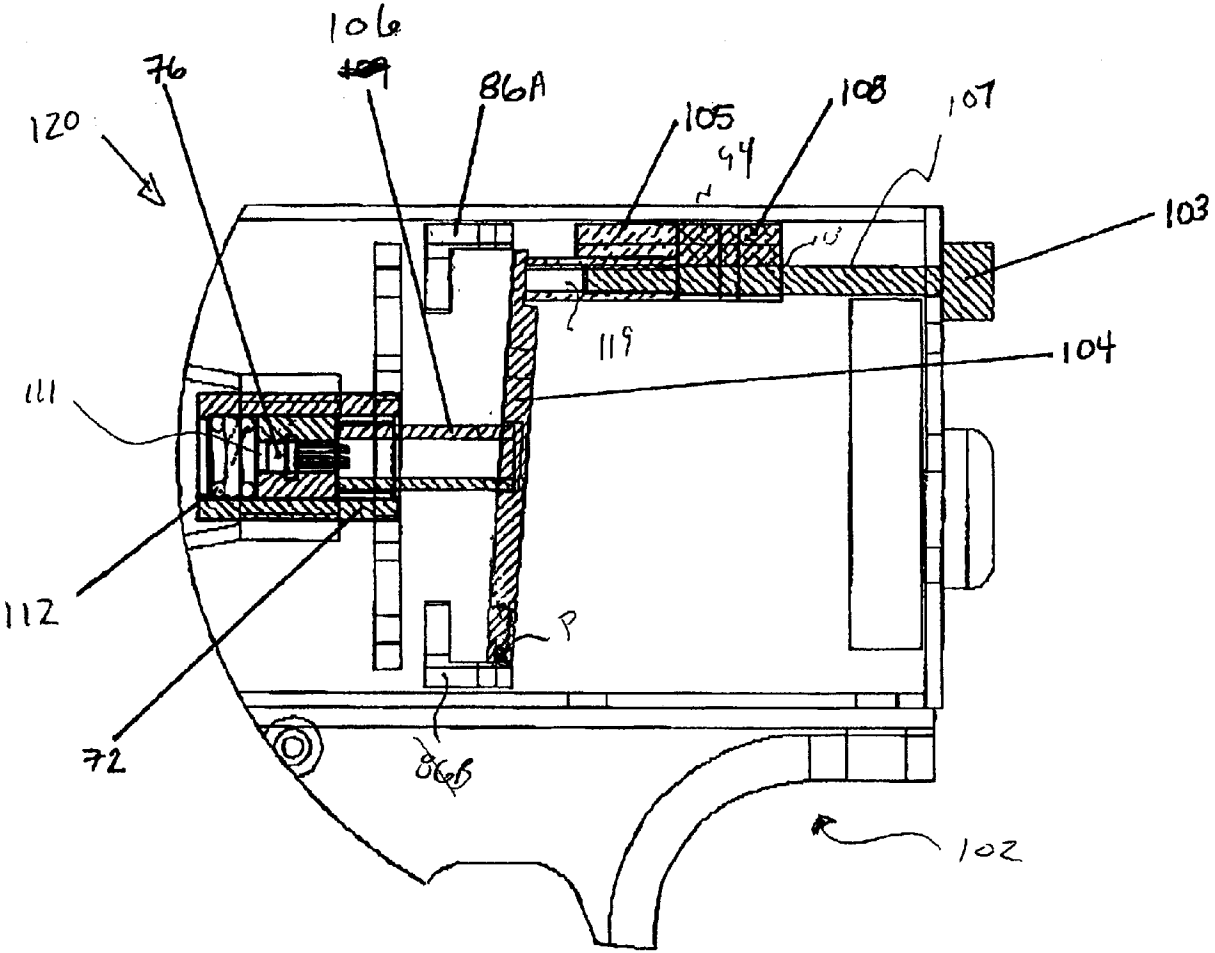
FIG. 19 is View A of FIG. 16 illustrating one embodiment of a beam adjustment mechanism of the hand-held device of FIG. 15.

As illustrated in FIG. 19, one embodiment 120 of the many possible mechanical beam adjustment mechanisms to achieve variable laser beam focus includes an adjustment knob 103, beam adjustment slide 105, beam adjustment lever 104, and beam adjustment tube 106. The adjustment knob 103 has an externally threaded shaft 107 compatible with the internally threaded bore 119 of the beam adjustment slide 105, such that when adjustment knob 103 is rotated, the adjustment beam slide 105 moves forward or backward. The adjustment beam slide 105 contacts the beam adjustment lever 104, which causes adjustment lever 104 to pivot about point P of lower clamping bracket 86B forward or backward depending on the rotational direction of adjustment knob 103. Adjustment lever 104 contacts beam adjustment tube 106 causing beam adjustment tube 106 to contact laser diode 76, which is slidably contained inside the bore 111 of laser diode heat sink/collimation adjustor 72, allowing the laser diode 76 to move relative to collimating optical system 68, as shown in FIG. 16.

In the mechanical beam adjustment mechanism described-above, a beam adjustment spring 112 (see FIG. 19) is provided to exert a force to slide the laser diode 76 back to a predetermined position as the adjustment knob 103 is turned in the reverse direction. The beam adjustment spring 112 compresses as the adjustment knob 103 turns, for example counter clockwise, to focus on birds at short distances. As the distance increases, the laser diode 76 must slide back to focus on the birds at the new distance. The beam adjustment spring 112 provides the backward force as the adjustment knob 103 turns, for example clockwise, to slide the laser diode 76 back.

There are many mechanical methods to stop the forward movement of the laser diode 76. Mechanical methods can include one or more stops, for example, the beam adjustment spring 112 being fully compressed, or, preferably, by the adjustment lever 104 contacting the clamping bracket 86A conventionally attached to housing 94, shown in FIG. 19. However, other surfaces can be used as contact or stopping surfaces.

Similarly, the backward movement of the laser diode 76 can be controlled by mechanical stops too. Preferably, beam adjustment stop 108 provides the physical constraint to stop backward movement of the mechanical system. Beam adjustment stop 108 is conventionally attached to housing 94. The preferred embodiment of the beam adjustment stop 108 includes a bore 113 sized larger than the outer diameter of the externally threaded shaft 107, such that the externally threaded shaft 107 does not bind within bore 113. However, the present invention is also operable with a boreless stop. The externally threaded shaft 107 passes through the bore 113 of the beam adjustment stop 108 and is threaded into adjustment beam slide 105. The backward movement of the laser diode 76 stops when the adjustment beam slide 105 contacts the beam adjustment stop 108.

Figure 20:
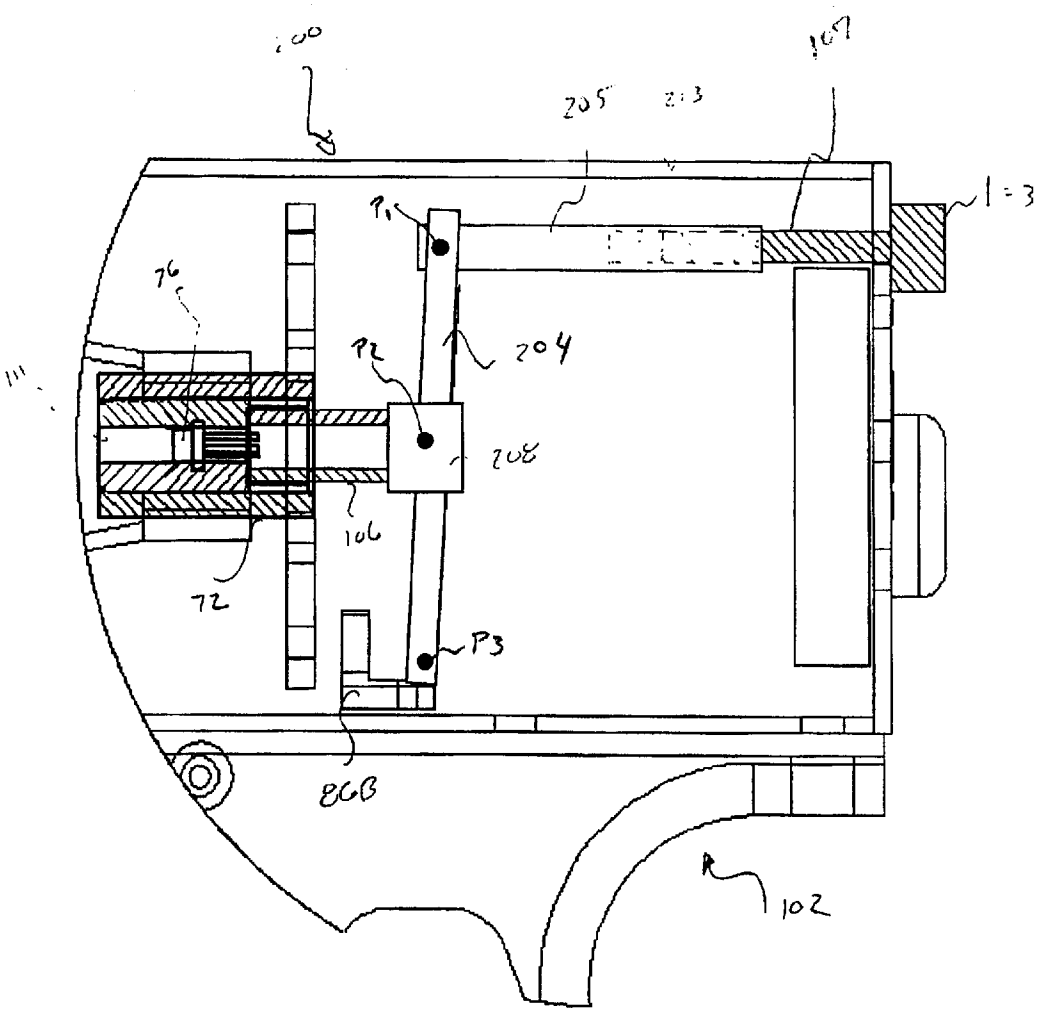
FIG. 20 is a cross-section view of another embodiment of a beam adjustment mechanism of the hand-held device of FIG. 15.

An alternative mechanical system for the beam adjustment mechanism is a linkage system 200, as shown in FIG. 20. As with the lever system, linkage system 200 preferably is a manually operated mechanical system, but can be automated. One embodiment of the many possible mechanical linkage systems to achieve variable laser beam focus includes common components of the preferred beam adjustment mechanism described-above with the same numbering scheme in cooperation with new linkage components: an adjustment knob 103, linkage beam adjustment slide 205, linkage beam adjustment rod 204, and linkage pivot plate 208 attached to beam adjustment tube 106. The adjustment knob 103 has an externally threaded shaft 107 compatible with the internally threaded bore 213 of the linkage beam adjustment slide 205, such that when adjustment knob 103 is rotated, the linkage adjustment beam slide 205 moves forward or backward. The adjustment beam slide 205 is pivotly contacted at point P1 to the linkage beam adjustment rod 204, which causes linkage adjustment rod 204 to pivot about point P3 of the lower clamping bracket 86B forward or backward depending on the rotational direction of adjustment knob 103. Linkage adjustment rod 204 is pivotly contacted at point P2 to beam adjustment tube 106 by pivot plate 208, which is fixedly attached to beam adjustment tube 106. The beam adjustment tube 106 contacts laser diode 76, which is slidably contained inside the bore 111 of laser diode heat sink/collimation adjustor 72, allowing the laser diode 76 to move relative to collimating optical system 68, as shown in FIG. 16. The beam adjustment spring 112 has been eliminated along with the mechanical stops clamping bracket 86A and beam adjustment stop 108.

Figure 21:
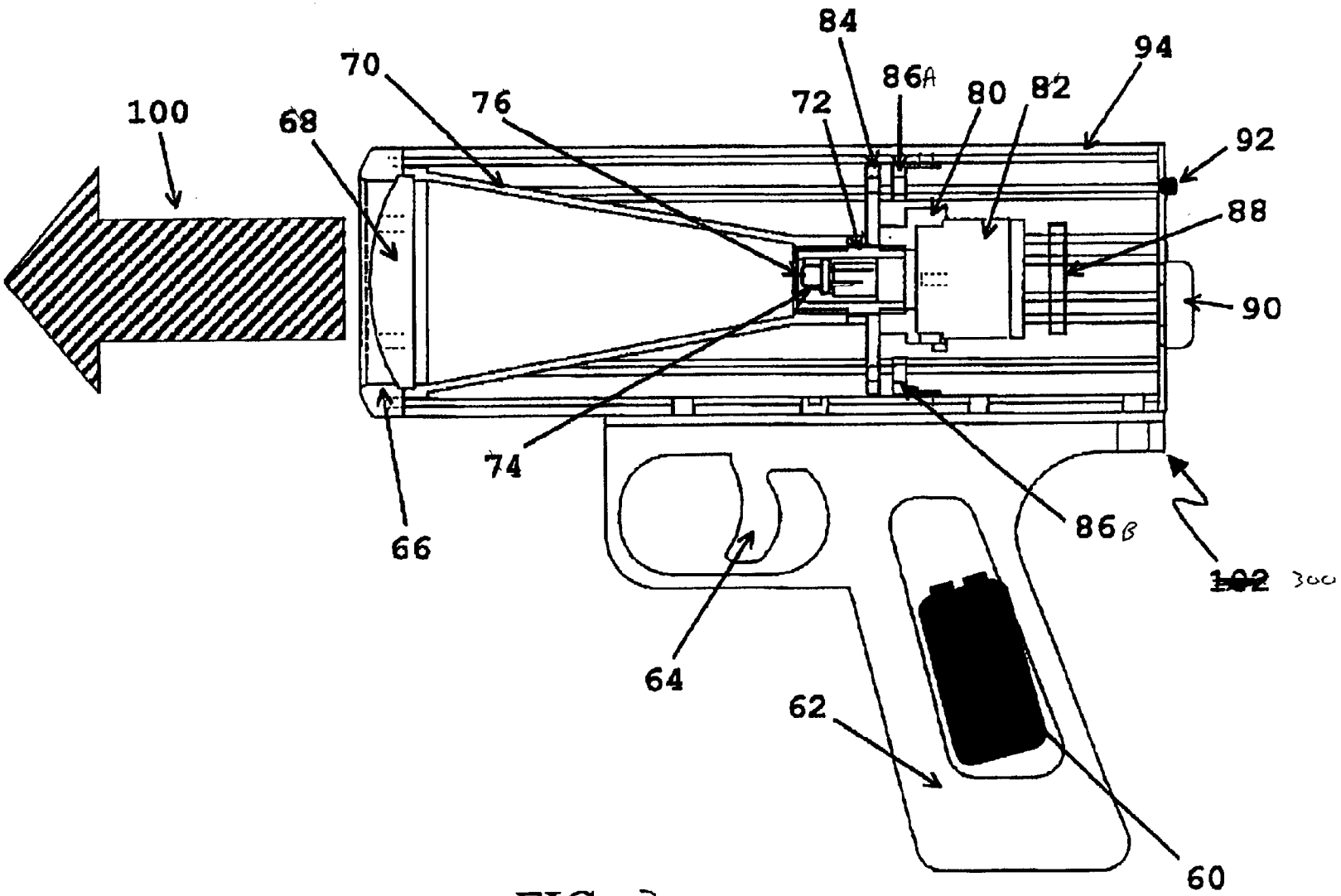
FIG. 21 is a cross-section view of an alternative embodiment of the hand-held device of FIG. 15 having a fixed beam focus length.

In yet another embodiment 300 of the present invention, illustrated in FIG. 21, the laser diode 76 is in a fixed position using common components of the preferred and alternative embodiments except the beam adjustment mechanism is eliminated for design simplicity. The components of this embodiment include: battery 60, hand grip 62 with manual trigger 64, optical front cover 66, collimating optical system 68, lens cone 70, laser diode heat sink/collimation adjustor 72, laser diode mount 74, laser diode 76, electronics mount 80, laser diode power supply 82, anchor plate 84, upper clamping bracket 86A, lower clamping bracket 86B, safety interlock electronics 88, key switch interlock 90, an armed light-emitting diode (LED) status indicator 92A, a laser LED status indicator 92B, and housing 94.

Figure 22:
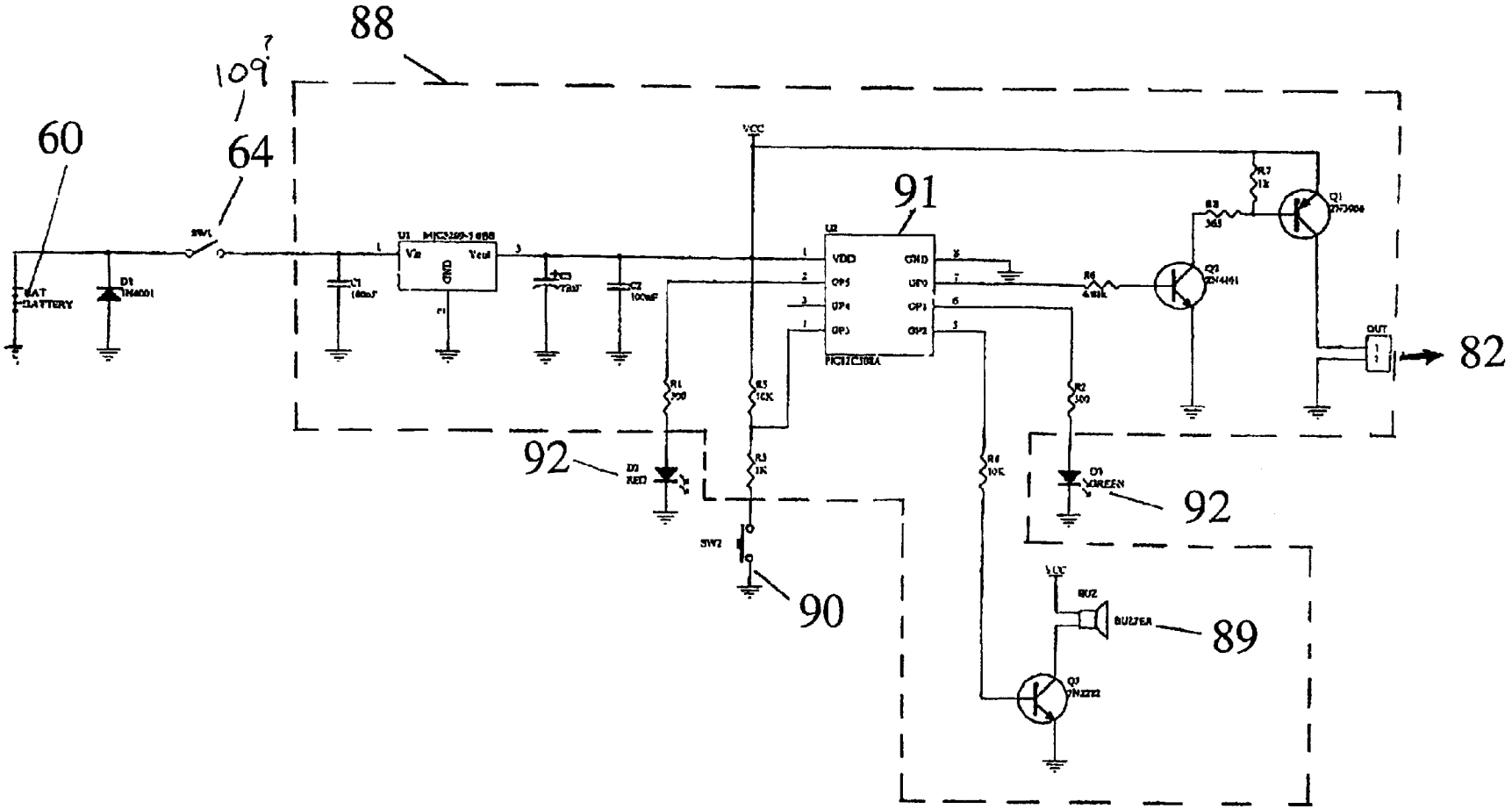
FIG. 22 is a schematic showing the safety interlock electronics and associated electrical components.

Now turning to FIGS. 16, 17 and 22, the preferred handheld embodiment of the present invention is operated by first arming the system by turning the key switch interlock 90 to the "on" position, which illuminates the armed LED status indicator 92A. Aim device 102 at a target area and depress the manual trigger 64 on the hand grip 62 to activate the trigger switch 109. Buzzer 89 emits a short beep and the laser LED status indicator 92B begins flashing at an increasing rate for a period of approximately three seconds. After this delay period of approximately three seconds, the safety interlock electronics 88 enable the power supply 82 to provide the appropriate amount of current to the laser diode 76. The programmable interface chip (PIC) 91 controls the key functions of the invention including, among others, the approximate three second delay, the buzzer 89, the LED indicators 92A, 92B, and the 5 volt signal to the laser diode power supply 82. A substantially collimated, radially-uniform laser beam 100 exits the device 102 and produces a sharply-defined bright laser spot on the target area, which target area may be a large distance away from the device 102. The spot size of the laser beam 100 can be adjusted by turning the beam adjustment knob 103 clockwise for a smaller diameter laser beam 100 or counter-clockwise for a larger diameter laser beam 100. The preferred spot size on the target is approximately 6 to 12 inches in diameter. The bright laser spot on the target area may be moved simply by re-aiming the device 102. The bright laser spot on the target may be used to disperse, or cause to be dispersed, birds in or near the target area.

Figure 23:
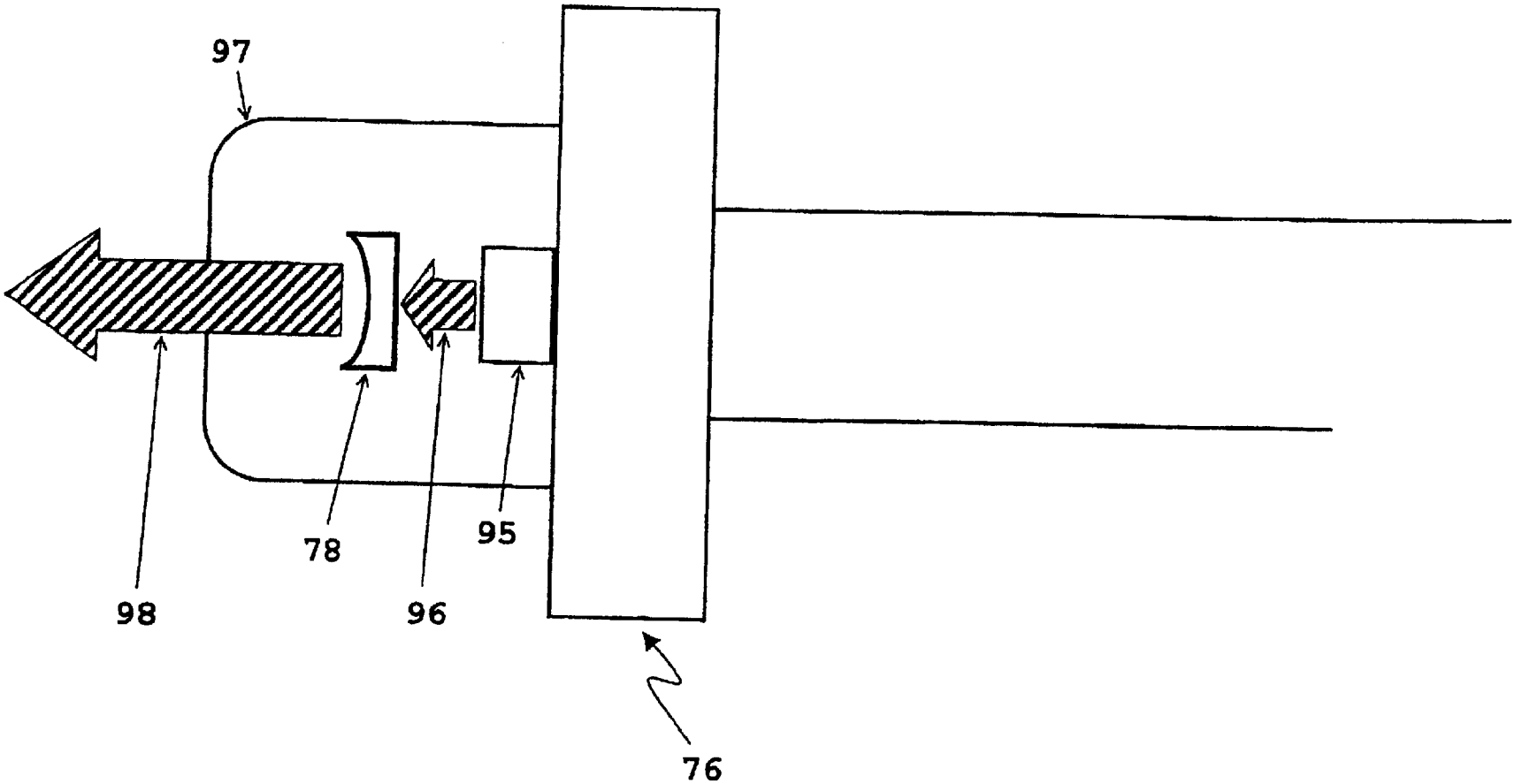
FIG. 23 is a schematic showing a laser diode with beam forming optics.
Figure 16:
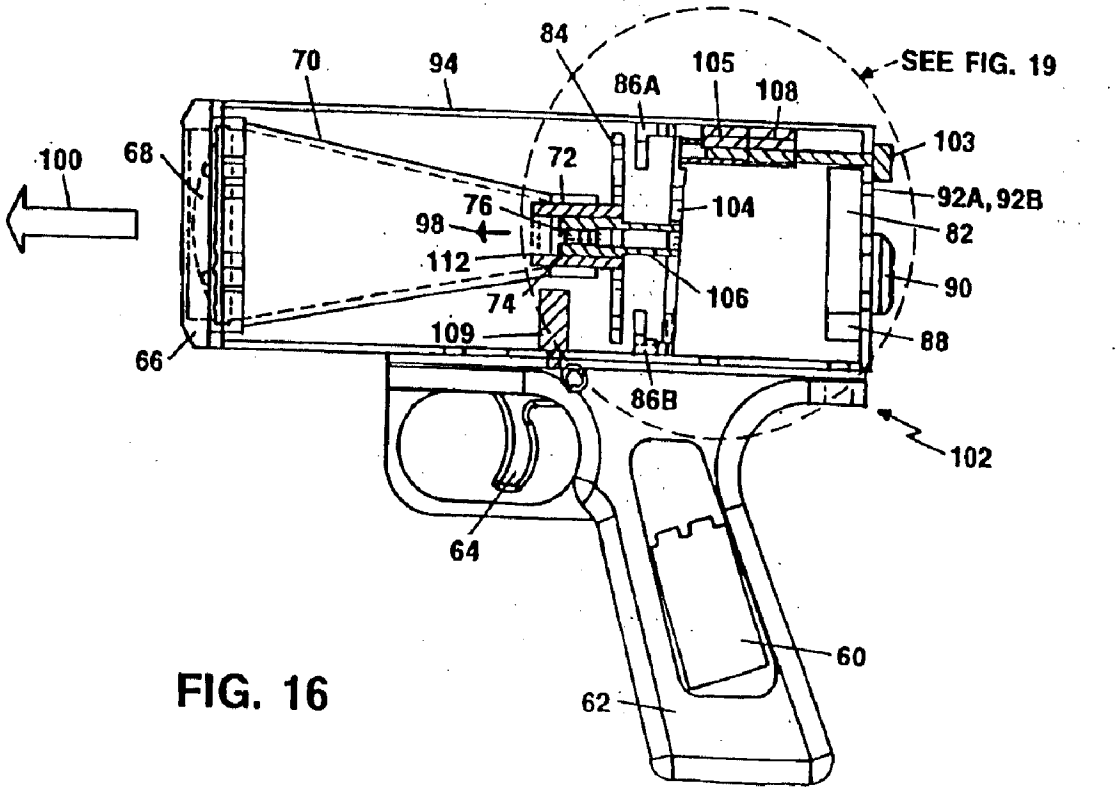
Figure 17:
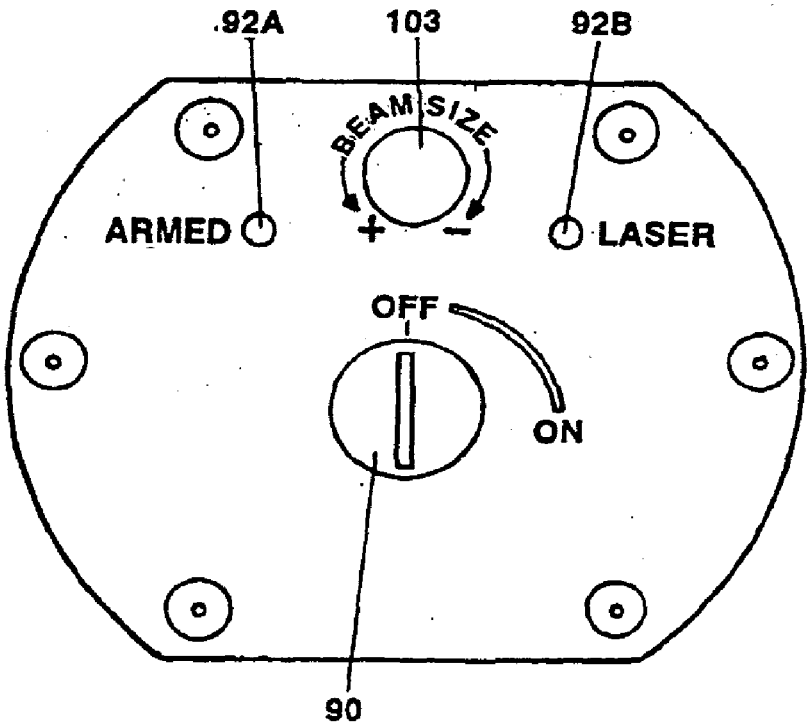
Figure 18:
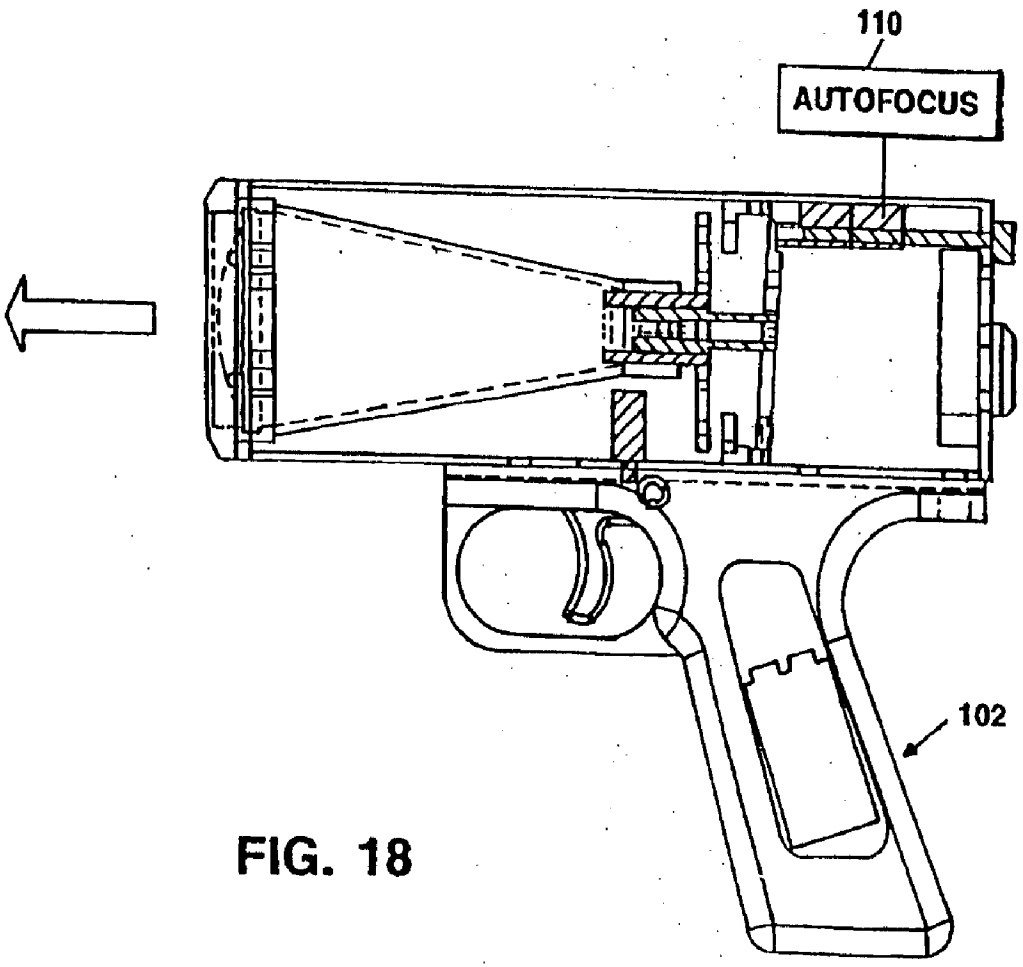
Figure 19:
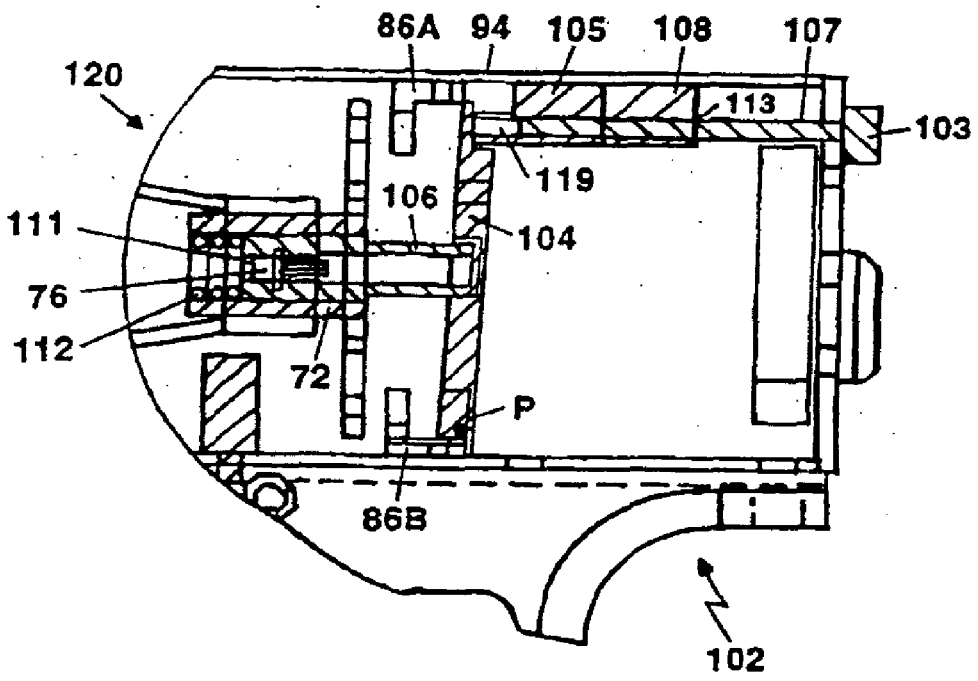
Figure 20:
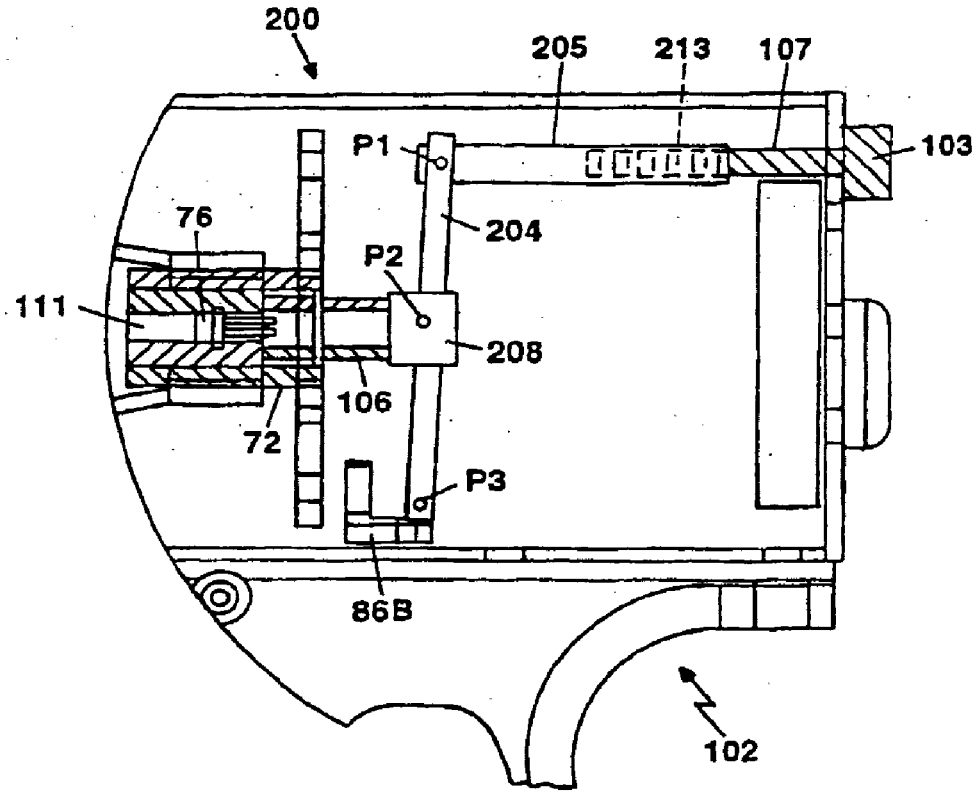
Figure 21:
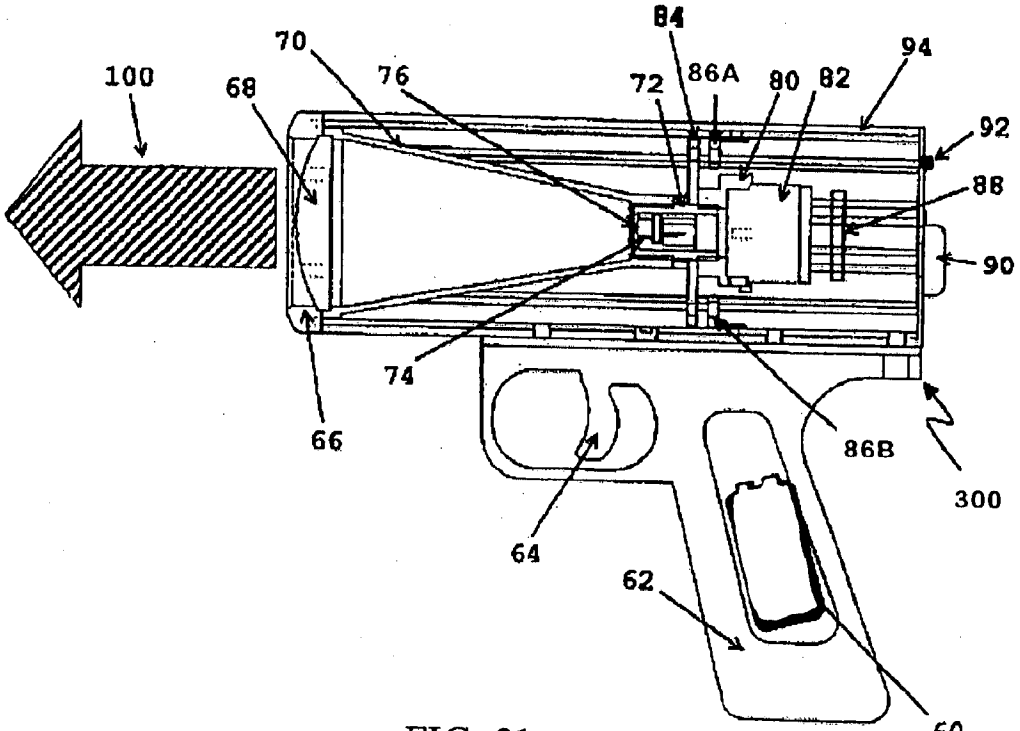
Figure 22:
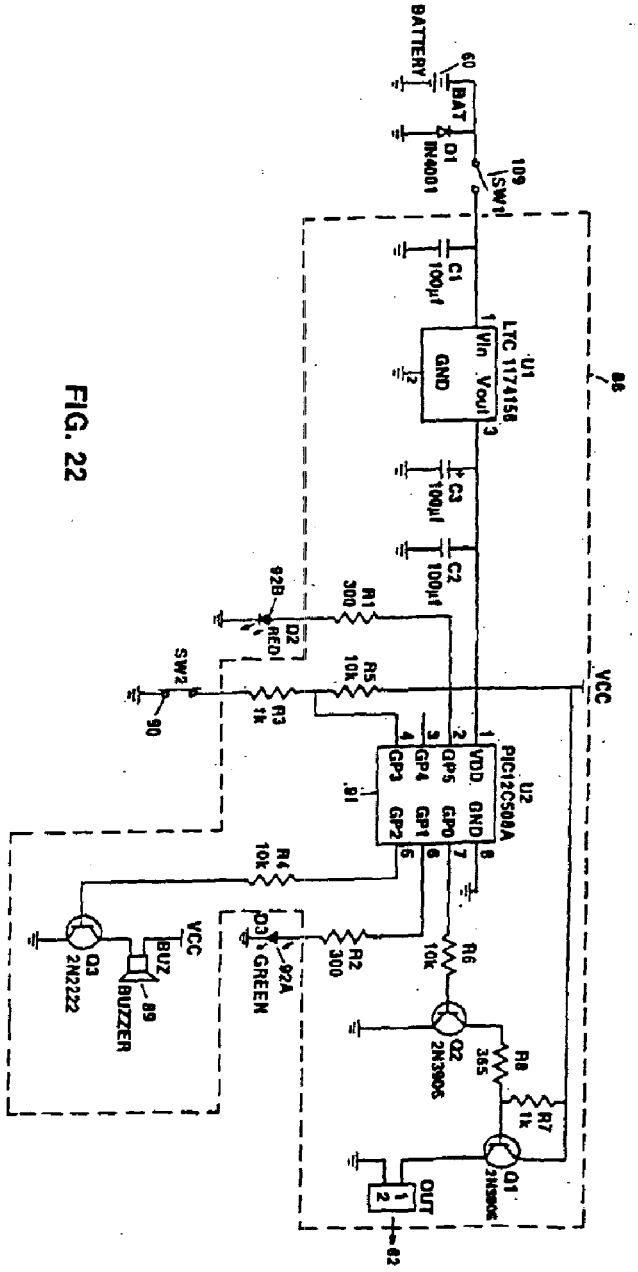

As illustrated in FIG. 23, the laser diode 76 preferably includes a laser diode chip 95 and beam forming optics 78, packaged into a laser diode housing 97. When supplied with the proper current from the power supply 82, the laser diode chip 95 produces a beam of non-radially-uniform light 96, which passes through beam forming optics 78 and emerges from the laser diode housing 97 as radially-uniform light 98. Non-radially-uniform light 96 from a typical laser diode chip 95 has a larger rate of divergence in one direction (for example the horizontal axis) and a smaller rate of divergence in the opposite direction (for example the vertical axis), similar to an elliptical shape. Non-radially-uniform light 96 from the laser diode chip 95 is incident upon beam-forming optics 78, preferably a single micro-lens, produced by Blue Sky Optical Systems. The purpose of the beam-forming optics 78 is to alter the non-radially-uniform laser light 96 so that it becomes substantially radially-uniform 98, similar to a circular shape. Now returning to FIG. 16, the substantially radially-uniform laser light 98 is next incident upon a collimating optical system 68, including one or more lens. The purpose of the collimating optical system 68 is to substantially collimate the radially-uniform laser beam 98. A substantially collimated, radially-uniform laser beam 100 exits the device 102.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. An apparatus to disperse birds comprising:

a housing capable of being held in a hand, said housing having at least one opening;

a light means for emitting a light beam mounted in said housing;

an actuating mechanism operably connected to said light means, said actuating mechanism being capable of actuating said light means in response to an input;

said actuating mechanism includes a trigger, a key switch interlock having an "on" and "off" position electrically connected between said trigger and said light means, and a light indicator electrically connected to said key switch interlock, said key switch interlock being capable of preventing actuation of said apparatus, said light indicator being capable of illumination when said key switch interlock is in the "on" position, whereby a user is visually alerted the system is on and ready for said input to said light means, said input being produced by a depression of said trigger by a finger of the hand; and said light beam being emitted from said light means through said at least one opening in response to said input of said actuating mechanism, whereby said light beam is capable of disorienting the birds in order to disperse the birds from their present location.

2. The apparatus according to claim 1 further comprising a power source electrically connected to said actuating mechanism.

3. The apparatus according to claim 1 wherein said actuating mechanism further comprises a sound generator capable of emitting at least one beep in response to said trigger being depressed, whereby the user is audibly alerted that said light means is preparing to discharge said light beam.

4. The apparatus according to claim 1 wherein said actuating mechanism further comprises another light indicator, said another light indicator capable of illumination in response to said trigger being depressed, whereby the user is visually alerted that said light means is preparing to discharge said light beam.

5. The apparatus according to claim 1 wherein said actuating mechanism further comprises a timer to delay power transfer to said light means for a predetermined time, whereby the user is given time to aim said apparatus at a target.

6. The apparatus according to claim 1 further comprising a light beam adjustment mechanism operably connected to said light means, wherein said light beam adjustment mechanism being capable of increasing or decreasing the size of said light beam emitted from said light means.

7. The apparatus according to claim 6 wherein said light beam adjustment mechanism being a linkage system comprising:

a beam size adjustment device movably connected to said housing;

a plurality of longitudinal structures pivotally connected to each other forming a single link having two ends;

said one end of said single link is pivotally connected to said beam adjustment device;

said other end is pivotally connected to said housing; and said light means being pivotally connected to said single link, whereby the movement of said beam size adjustment device moves said light means forward or backward to adjust the size of the laser spot.

8. The apparatus according to claim 7 said linkage system further comprising an autofocus.

9. The apparatus according to claim 6 wherein said light beam adjustment mechanism being a linkage system comprising:

an adjustment knob having an externally threaded shaft, wherein said adjustment knob is rotatably connected to said housing;

a linkage beam adjustment slide having a longitudinal structure with an internally threaded bore through a predetermined length of said longitudinal structure, said internally threaded bore being rotatably compatible with said externally threaded shaft, wherein said linkage beam adjustment slide is in slidable contact with said housing; and a linkage beam adjustment rod having a longitudinal structure with two ends and a mid-section, wherein one end of said ends is pivotally connected to said linkage beam adjustment slide and the another end of said ends is pivotally connected to said housing and said mid section is pivotally connected to said light means, whereby the rotation of said adjustment knob moves said light means forward or backward to adjust the size of the laser spot.

10. The apparatus according to claim 9 said linkage system further comprising an autofocus.

11. The apparatus according to claim 6 wherein said light beam adjustment mechanism is a lever system comprising:

an adjustment knob having an externally threaded shaft, wherein said adjustment knob is rotatably connected to said housing;

a beam adjustment slide having a longitudinal structure with an internally threaded bore through a predetermined length of said longitudinal structure, said internally threaded bore being rotatably compatible with said externally threaded shaft such that when said adjustment knob is rotated, said adjustment beam slide moves forward or backward; and a beam adjustment lever having a longitudinal structure with two ends and a mid-section, wherein said one end of said ends contacts said beam adjustment slide and said another end of said ends is pivotally connected to said housing and said mid section is in movable contact with said light means, whereby the rotation of said adjustment knob moves said light means forward or backward to adjust the size of the laser spot.

12. The apparatus according to claim 11 wherein said lever system further comprises a spring, whereby said spring compresses as the rotation of said adjustment knob moves said light means forward, and whereby said spring exerts a force to move said light means in the opposite direction as said adjustment knob is turned in the reverse direction.

13. The apparatus according to claim 11 said lever system further comprising an autofocus.

14. The apparatus according to claim 1 wherein said light means comprises a light emitting diode.

15. The apparatus according to claim 14 wherein said light emitting diode is a laser diode.

16. The apparatus according to claim 15 wherein said laser diode comprises:

a laser diode chip;

beam forming optics to optical communication with said laser diode chip; and a laser diode housing to enclose said laser diode chip and said beam forming optics, whereby laser diode chip produces a beam of non-radially-uniform light that passes through said beam forming optics and emerges from the laser diode housing as a substantially radially-uniform light.

17. The apparatus according to claim 16 wherein said light means further comprises a collimating optical system having at least one lens in optical communication with said laser diode, whereby said collimating optical system substantially collimates said substantially radially-uniform light prior to exiting said housing.

18. The apparatus according to claim 17 wherein said light means further comprises:

an optical front cover to secure said a collimating optical system to said housing;

a lens cone disposed between said laser diode and said collimating optical system;

a laser diode heat sink/collimation adjustor having a bore with a diameter sized to slightly larger than said laser diode, whereby said laser diode is slidable within said bore of said laser diode heat sink/collimation adjustor;

a laser diode mount to attach said laser diode heat sink/collimation adjustor to said housing; and a laser diode power supply operably connected to said actuating mechanism and said laser diode.

19. The apparatus according to claim 1 wherein said housing is formed in the shape of a gun.

20. An apparatus to disperse birds comprising:

a housing capable of being held in a hand, said housing having at least one opening;

a light means for emitting a light beam mounted in said housing;

an actuating mechanism operably connected to said light means;

said actuating mechanism being capable of actuating said light means in response to an input;

said light beam being emitted from said light means through said at least one opening in response to said input of said actuating mechanism;

a light beam adjustment mechanism operably connected to said light means, wherein said light beam adjustment mechanism being capable of increasing or decreasing the size of said light beam emitted from said light means;

wherein said light beam adjustment mechanism comprises, an adjustment knob having an externally threaded shaft, wherein said adjustment knob is rotatably connected said housing;

a beam adjustment slide having a longitudinal structure with an internally threaded bore through a predetermined length of said longitudinal structure, said internally threaded bore being rotatably compatible with said externally threaded shaft such that when said adjustment knob is rotated, said adjustment beam slide moves forward or backward;

a beam adjustment lever having a longitudinal structure with two ends and a mid-section, wherein said one end of said ends contacts said beam adjustment slide and said another end of said ends is pivotally connected to said housing and said mid section is in movable contact with said light means;

a spring, wherein said spring compresses as the rotation of said adjustment knob moves said light means forward, and whereby said spring exerts a force to move said light means in the opposite direction as said adjustment knob is turned in the reverse direction; and, whereby the rotation of said adjustment knob moves said light means forward or backward to adjust the size of the laser spot, wherein said light beam is capable of disorienting the birds in order to disperse the birds from their present location.

* * * * *

UNITED STATES PATENT AND TRADEMARK OFFICE

CERTIFICATE OF CORRECTION

PATENT NO. : 6,793,364 B2
DATED : September 21, 2004
INVENTOR(S) : Cramer et al.

It is certified that error appears in the above-identified patent and that said Letters Patent is hereby corrected as shown below:

Title page,
The illustrative figure should be deleted and substitute therefore the attached title page.

Drawings,
Delete Figures 16, 17, 18, 19, 20, 21 and 22, and substitute therefore Figures 16, 17, 18, 19, 20, 21 and 22, shown on the attached 7 pages.

Signed and Sealed this

Twenty-first Day of December, 2004

JON W. DUDAS
*Director of the United States Patent and Trademark Office*

(12) United States Patent
Cramer et al.

(10) Patent No.: US 6,793,364 B2
(45) Date of Patent: Sep. 21, 2004

(54) NON-LETHAL VISUAL BIRD DISPERSAL SYSTEM

(75) Inventors: Eric J. Cramer, Albuquerque, NM (US); Michael D. Tocci, Sandia Park, NM (US)

(73) Assignee: Science & Engineering Associates, Inc., Albuquerque, NM (US)

( * ) Notice: Subject to any disclaimer, the term of this patent is extended or adjusted under 35 U.S.C. 154(b) by 0 days.

(21) Appl. No.: 10/175,930

(22) Filed: Jun. 20, 2002

(65) Prior Publication Data

US 2002/0154498 A1 Oct. 24, 2002

Related U.S. Application Data

(63) Continuation-in-part of application No. 09/785,701, filed on Feb. 16, 2001, now Pat. No. 6,575,597, which is a continuation-in-part of application No. 09/409,328, filed on Sep. 30, 1999, now Pat. No. 6,190,022, which is a continuation-in-part of application No. 08/967,426, filed on Nov. 10, 1997, now Pat. No. 6,007,218, which is a continuation-in-part of application No. 08/518,230, filed on Aug. 23, 1995, now Pat. No. 5,685,636.

(60) Provisional application No. 60/300,347, filed on Jun. 22, 2001, and provisional application No. 60/135,231, filed on May 21, 1999.

(51) Int. Cl.[7] ..... F41G 1/34; F21V 19/02

(52) U.S. Cl. ..... 362/112; 362/188; 362/259; 362/285

(58) Field of Search ..... 362/110–114, 187, 362/188, 253, 259, 285

(56) References Cited

U.S. PATENT DOCUMENTS

| | | | | |
|---|---|---|---|---|
| 2,353,082 A | | 7/1944 | Roedding et al. | 240/48 |
| 3,013,145 A | | 12/1961 | Trippe | 240/49 |
| 3,062,144 A | | 11/1962 | Hori et al. | 102/38 |
| 4,048,631 A | | 9/1977 | Flores | 362/184 |
| 4,281,993 A | * | 8/1981 | Shaw | 362/113 |
| 4,736,907 A | | 4/1988 | Steffen | 244/1 R |
| 4,934,086 A | * | 6/1990 | Houde-Walter | 362/110 |

(List continued on next page.)

FOREIGN PATENT DOCUMENTS

| | | | |
|---|---|---|---|
| FR | 2662234 | 11/1991 | F21M/1/00 |
| JP | 406284847 | 10/1994 | A01M/29/00 |
| JP | 0970250 | 3/1997 | A01M/29/02 |
| WO | WO 97/08489 | 3/1997 | |
| WO | WO 99/24755 | 5/1999 | |

OTHER PUBLICATIONS

U.S. patent application Ser. No. 09/785,701, Cramer et al., filed Feb. 16, 2001.

U.S. Provisional patent application Ser. No. 60/300,347, Cramer et al., filed Jun. 22, 2001.

Desman S.A.R.L. Web site, www.desman.fr, downloaded Nov. 22, 2002, product information including photographs.

*Primary Examiner*—Alan Cariaso
(74) *Attorney, Agent, or Firm*—Perkins Smith & Cohen, LLP; Jacob N. Erlich

(57) ABSTRACT

A non-lethal method and devices for dispersing nuisance birds from a preselected area. Such nuisance birds disrupt many activities such as the steady flow of safely moving aircraft on runways and adjacent thereto, growing crops on farmland, playing golf and the use of the interior of large open buildings. The present method utilizes a series of bright light sources that are positioned adjacent the area from which the birds are to be dispersed. The light sources are activated to produce one or more beams of bright light that are moved in such a manner to produce a pattern of bright light in the vicinity of the birds to be dispersed. This action causes the birds to become sufficiently startled and disoriented so as to disperse these nuisance birds from the area to be cleared.

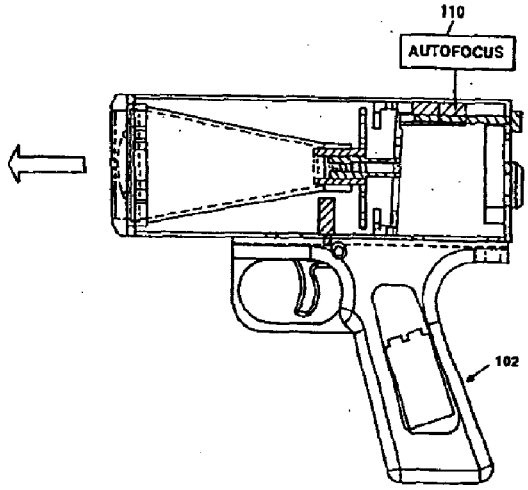

20 Claims, 23 Drawing Sheets